United States Patent [19]

Schöne et al.

[11] 4,388,494

[45] Jun. 14, 1983

[54] PROCESS AND APPARATUS FOR IMPROVED DUMMY HEAD STEREOPHONIC REPRODUCTION

[76] Inventors: Peter Schöne, No. 13, Rosenstrasse, 8011 Aschheim; Jürgen Ölmann, No. 5, Davidstrasse, 8000 Munich 89; Helmut Lamparter, No. 36, Rosenstrasse, 8011 Kirchheim, all of Fed. Rep. of Germany

[21] Appl. No.: 222,475

[22] Filed: Jan. 5, 1981

[30] Foreign Application Priority Data

Jan. 12, 1980 [DE] Fed. Rep. of Germany ..... 3001007
Feb. 2, 1980 [DE] Fed. Rep. of Germany ..... 3003852

[51] Int. Cl.[3] ..... H04S 1/00
[52] U.S. Cl. ..... 179/1 G; 179/1 GP
[58] Field of Search ..... 179/1 G, 1 GP

[56] References Cited

U.S. PATENT DOCUMENTS 3,985,960 10/1976 Wallace ..... 179/1 G
4,139,728 2/1979 Haramoto et al. ..... 179/1 G
4,192,969 3/1980 Iwahara ..... 179/1 G
4,209,665 6/1980 Iwahara ..... 179/1 G
4,309,570 1/1982 Carver ..... 179/1 G

FOREIGN PATENT DOCUMENTS 2822735 11/1979 Fed. Rep. of Germany ..... 179/1 G

*Primary Examiner*—A. D. Pellinen
*Attorney, Agent, or Firm*—John C. Smith, Jr.

[57] ABSTRACT

In stereophonic reproduction using a dummy head process, the frequency responses of the microphones are equalized by free-field matching filters to provide overall transfer constants independent of frequency. Signals produced by the above-equalized dummy head apparatus are applied to a decoupling filter which corrects for the directional pattern of the dummy head. The decoupled signals are suitable for loudspeaker reproduction. The decoupled signals can be further applied to a second decoupling network which can be adjusted to produce headphone stereophonic signals matched to a listener's individual directional hearing pattern.

11 Claims, 21 Drawing Figures

SOURCE
REFERENCE DIRECTION

SOURCE
SOURCE
(φ, δ)
(φ1, δ1)
(φ2, δ2)
left
right
20
30
Mli
Mre
B13
B14
B11
B12
B15
B16
B10
Are(f,φ1,δ1)
Ali(f,φ2,δ2)
B17
B18
L1
L2
REFERENCE DIRECTION
C1(f)
C2(f)
80
90
50
40
100

PROCESS AND APPARATUS FOR IMPROVED DUMMY HEAD STEREOPHONIC REPRODUCTION

BACKGROUND OF THE INVENTION

This invention relates to a stereophonic transmission process involving the use of a dummy head and headphones and to means for carrying out the process.

These types of head-related transmission systems are provided with a dummy head simulating a human head at the start of the transmission chain and headphones at the end of the transmission chain. The following transmission system has entered practical usage: at the place of sound pick-up a dummy head is located which reproduces as well as possible the total acoustical conditions existing at a natural head (for example a dummy head as described in German Pat. No. 19 27 401), that is to say the signals from the microphones of this dummy head should correspond as accurately as possible to the signals at the ears of a natural head. These microphone signals are recorded on a sound recording medium (for example a record or tape) and/or transmitted on a transmission path (for example a stereophonic broadcasting channel). Sound reproduction takes place by means of commercially available headphones.

Head-related transmission systems of this type have a number of grave defects which have led to the situation that this transmission method, which, in itself, is very efficient, has hitherto found only little acceptance:

(a) In the form described, head-related stereophony is generally thought to be not compatible with conventional, space-related stereophony, that is to say both the reproduction by loudspeaker of the signals from dummy heads and the reproduction by headphones of conventional space-related stereo signals lead to auditory events which show transmission errors both with respect to space and to sound.

(b) Hitherto, no dummy heads have been designed which have transmission properties which correspond accurately enough to the basic design principles of these heads. For this reason, there is also no standardization for the communications-engineering-related transmission characteristics of dummy heads such as is in the natural order of things, for example, for microphones in space-related recording engineering. One consequence of this is that the transmission functions of the dummy head and the headphones are not matched to one another.

(c) The signal/noise ratio of the usual signals from dummy heads is too low in certain ranges of frequencies, so that the microphone hiss becomes audible although reproduction is correct in other respects.

(d) Head-related stereophony in the form described does not offer any possibility of individual matching, that is to say the differences, which are important for head-related transmission, in the directional pattern of the dummy head and of the individual listener are not taken into account.

Defects (a) to (d) are reflected in transmission errors with respect to localization, tone and freedom from interference of auditory events. As remedy, the following further developments have become known which, as partial solutions, relate in each case to one of the defects listed:

with respect to (a), loudspeaker reproduction of head-related stereo signals: German Offenlegungsschrift No. 25 39 390; headphone reproduction of space-related stereo signals: U.S. Pat. No. 3,088,997, German Offenlegungsschrift No. 20 07 623, German Offenlegungsschrift No. 22 44 162, Acustica Vol. 29 (1973) pp. 273–277, German Offenlegungsschrift No. 25 57 516, Radio Fernsehen Elektronik Vol. 28 (1979), Number 4, pp. 222–225;

with respect to (b), transfer functions of the dummy head: Rundfunktechnische Mitteilungen Vol. 22 (1978), pp. 22–27, Fortschritte der Akustik (advances in acoustics), VDE-Verlag Berlin (1978), p. 645;

with respect to (c), signal/noise ratio: Acustica Vol. 41 (1978), pp. 183–193;

with respect to (d), individual matching: U.S. Pat. No. 4,143,244.

Even if these further developments are taken into consideration, however, problems (a) to (d) are not solved [(b), (c)] or are solved inadequately [(a), (d)]. In addition, the known technical solutions for (a) and (d) are too elaborate in comparison to the improvement achieved by them. All the further developments suffer from the fact that they attempt to solve their respective partial problem in isolation and do not take into account the effects on the total head-related transmission system, including compatibility with conventional space-related stereophony. The result of this isolated type of approach has been that either partial problems were not appropriately set within the context of the total transmission task [(a), (b)] or that partial solutions were arrived at the expense of other partial problems [(b), (c)].

SUMMARY OF THE INVENTION

It is an object of the present invention to avoid these disadvantages and to provide a stereophonic transmission process which is suitable, with as little constructional effort as possible, for the true-to-the-original transmission of auditory events and for this purpose is simultaneously (1) compatible with space-related stereophony, (2) provided with transfer functions which can be implemented at the pick-up side and can be standardized, (3) shows an optimum signal/noise ratio with the stereo signals picked up, and (4) takes account of the individual directional pattern of a respective listener by individual matching at the reproduction side.

The advantages of the invention consist firstly in that the proposed dummy-head recording technique can be employed to a considerably greater extent than hitherto because of its unrestricted compatibility with space-related sound pick-up techniques. Secondly, the possibilities of reproduction are expanded many times over because the stereo signals transmitted at the audio pick-up/reproduction interface are suitable without restriction for reproduction by loudspeaker, that is to say for the most widespread type of reproduction. Thirdly, headphone reproduction becomes significantly more natural due to the individual matching. Fourthly, the transmission elements can be standardized and matched to each other in a simple manner. Altogether, the invention makes possible the true-to-the-original transmission of auditory events, that is to say a transmission system which picks up and reproduces the auditory events simultaneously orthophonically, with correct localization and without interfering inherent noise.

BRIEF DESCRIPTION OF THE DRAWINGS

Preferred embodiments of the invention will now be described by way of example and with reference to the accompanying drawings, in which.

DESCRIPTION OF THE PREFERRED EMBODIMENTS

Figure 1:
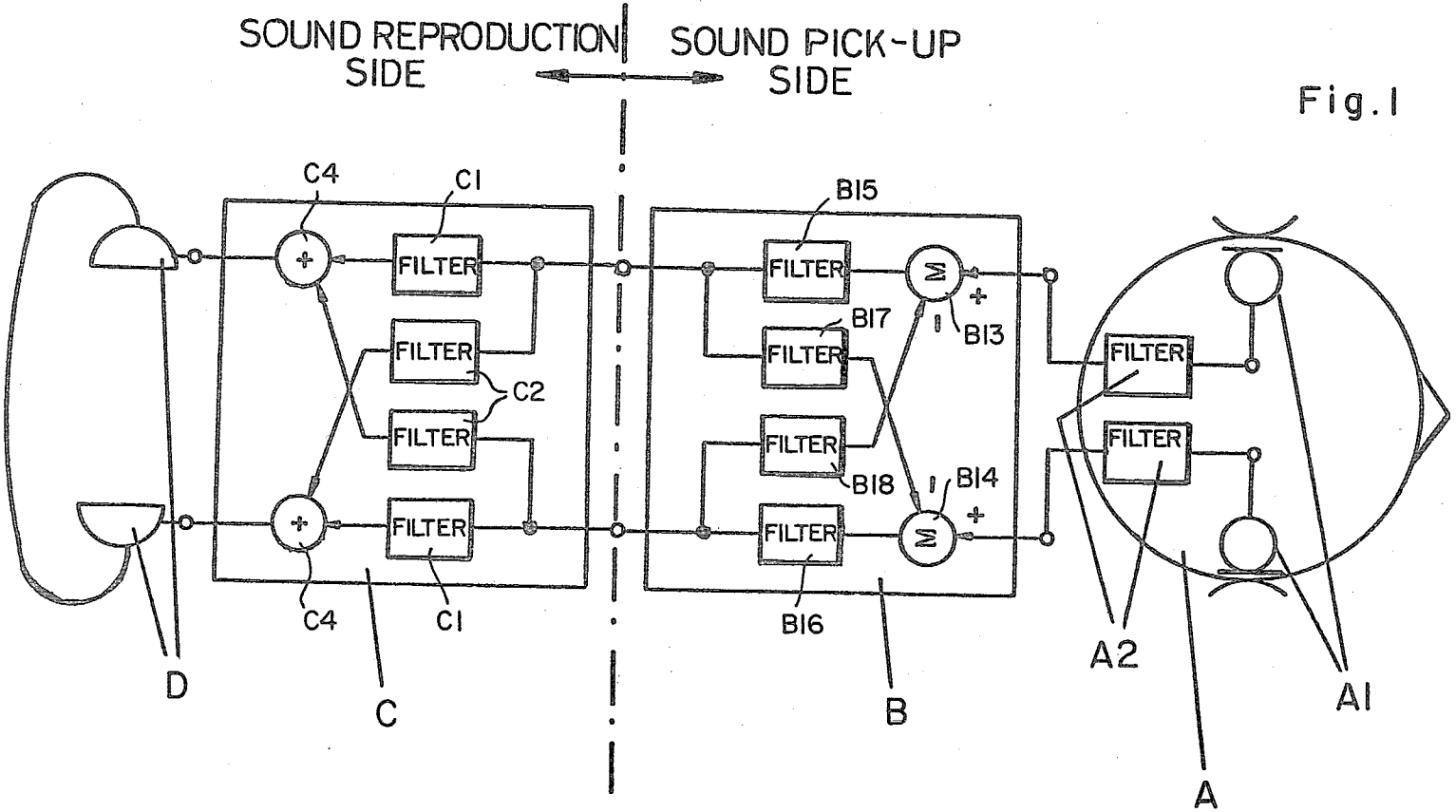
FIG. 1 shows the configuration of the transmission system according to the invention, consisting of four transmission elements.

FIG. 1 shows the configuration of the transmission system which consists of four transmission elements A, B, C and D, A being a dummy head simulating a human head in the method and filter arrangement A2 for the stereophonic picking up of sound signals, B a device for receiving signals which are stereophonic in a space-related manner, and C a circuit arrangement for matching a program signal, which is stereophonic in a space-related manner, to a pair of headphones D.

A METHOD AND FILTER ARRANGEMENT A2 FOR THE STEREOPHONIC PICKING UP OF SOUND SIGNALS BY MEANS OF A DUMMY HEAD A

The basic approach of head-related stereophony consists in that the natural spatial hearing process is to be simulated with the aid of a dummy head and a pair of headphones. To achieve this it is attempted to generate in the auditory canal of a test person, by means of head-related stereophony, the same auditory signals which would occur with natural hearing if the head of the test person were located directly in the position of the dummy-head sound pick-up. If this object is achieved with sufficient accuracy, head-related stereophony leads to a spatial representation of sound sources with a quality which has hitherto not been achieved by any other stereophonic process.

For the correct simulation of the natural auditory signals the stereophonic transmission path from the dummy head to the headphones must meet two essential conditions:

1. The dummy head must simulate the directional pattern of the human middle ear—with frontal sound incidence relative to the reference direction—with sufficient accuracy.

2. For this reference direction, the transfer function of the whole arrangement from the dummy head to the headphones must correspond to the free-field transfer function of the outer ear in a natural hearing process.

With the present state of the art, the first condition has already been well met (see for example the dummy head of German Pat. No. 19 27 401). By reproducing the geometry of the head, neck and external ear and by coupling two microphones into the auditory canals, two microphone signals can be obtained, the directional differences of which agree well with the directional interaural differences of an average listener.

However, the second condition has not been met satisfactorily. If with regard to the auditory signals in the auditory canal of the listener the natural hearing process is compared with dummy-head stereophony according to the state of the art introduced, for example, in the German broadcasting institutions, considerable deviations become apparent. These deviations are very clearly audible and lead to imaging defects with respect to tone and localization of sound sources. This applies to an equal extent for frontal and lateral sound incidence. The reason for this is found in the way the transfer functions of dummy head and headphones are combined.

The transfer function of the headphones used meets the requirements of DIN 45000 for high-quality headphones. Such headphones with free-field equalization generate in the auditory canal of a test person the same auditory signals as a loudspeaker with a transfer function which is independent of frequency and which is located a few meters in front of the test person. For this purpose the headphones have the same transfer function as the human outer ear. The headphones with free-field equalization, therefore, simulate the external ear function for frontal sound incidence.

With a dummy head the microphone signals approximate electrical analogs of auditory signals. In the electro-acoustical transmission chain of the head-related stereophonic system customarily in use today the external ear function for frontal sound incidence is contained a second time, and thus in total once too often, in the dummy head, which leads to the already-mentioned deviation from natural hearing.

A known method for the prevention of this transmission error is to use distortionless headphones instead of headphones with free-field equalization at the reproducton side. However, this manner of proceeding does not alter the fact that electrical analogs of auditory signals are still transmitted at the interface between the pick-up side and the reproduction side. In spite of the correct total transfer function, therefore, this solution shows a number of disadvantages as soon as the head-related stereophony system is to be used for transmissions which go beyond special laboratory applications (for example broadcasting or records).

For this reason, an important partial object of the present invention consists in that, in a process of the type mentioned initially, the equalizing functions are divided between the pick-up side and the reproduction side, whilst maintaining the correct total transfer function, in such a manner that the following advantages are achieved simultaneously:

(a) The transfer functions on the pick-up side should be suitable for standardization due to the fact that a precise nominal transfer function can be specified. It should be possible for reproduction to take place by means of headphones with free-field equalization and preferably by means of headphones with free-field equalization standardized in DIN 45500.

(b) It should be possible to determine the transfer functions at the sound pick-up side and at the sound reproduction side independently of each other and without complicated measurements with probes.

(c) The dummy-head signals at the interface to the sound reproduction side should be compatible, that is to say there should be no great changes in tone quality if they are reproduced by loudspeakers. (Preventing this compatibility error is the counterpart to preventing the other compatibility error according to which not the distortionless headphones but the headphones with free-field equalization are suitable for reproducing conventional space-related signals.)

(d) It should be possible to use the established sound-recording and sound-transmission processes without loss of quality (with respect to non-linear types of distortion and signal/noise ratio). The distortion of the dummy-head signals created by the frequency response of the outer ear (strong peaking of the center frequencies in the range around 3 kHz and clear attenuation of the high frequencies in the range around 10 kHz) should be avoided.

(e) It should be possible to match the total transfer function in a practicable manner to the individual. For this purpose, the pick-up side should not contain any characteristics for the reference direction which depend on the individual.

(f) One of the prerequisites which are necessary in order to be able to improve the signal/noise ratio of the dummy-head signals (with respect to microphone hiss) should be created.

Figure 9:
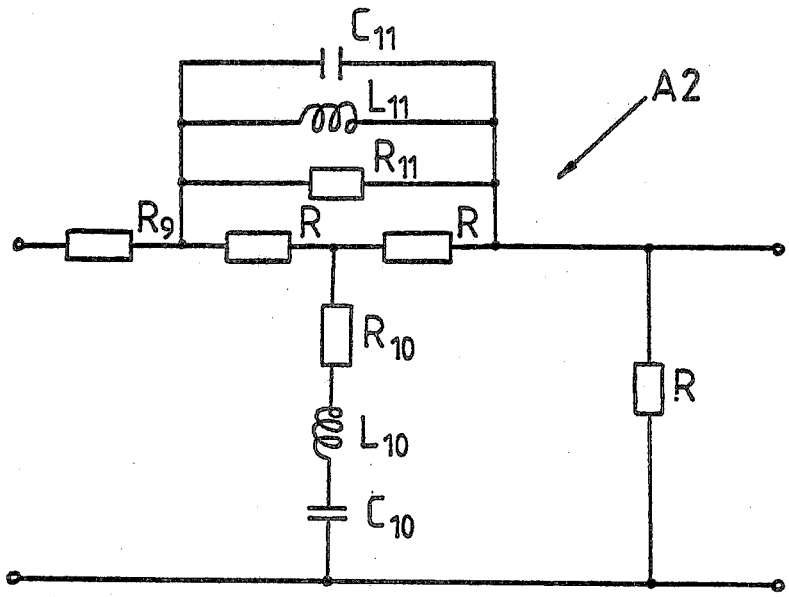
FIG. 9 shows an electric circuit of an illustrative embodiment of the filter arrangement provided in accordance with the invention.

This important partial object (appropriate distribution of the equalizer functions to the sound pick-up side and the reproduction side) is achieved by the invention by a filter arrangement A2 having a frequency response which is inverse with respect to the free-field transfer constant of the microphone arrangement for the reference direction of the free-field equalization of the headphones. A filter arrangement A2, which is suitable for carrying out the process according to the invention, is one in which a frequency response is provided which is inverse with respect to the free-field transfer constant for frontal sound incidence of the microphone arrangement. Particularly advantageous developments of this filter arrangement A2 may be effected if the filter arrangement is a passive band-rejection filter (FIG. 9) or the iterative connection (FIG. 4) of a band-pass filter A10, a first band-rejection filter A20 and a second band-rejection filter A30, the band-pass filter and each of the band-rejection filters being constructed in the form of bridged-T sections having input and output impedances which are independent of frequency.

With the aid of the process according to the invention the external ear transfer function of the dummy head, which is contained once too often in the dummy head/-headphones transmission chain, is completely compensated at the sound pick-up side so that the transfer function of the total dummy head arrangement, including the microphones A1 and the filter arrangement A2 following them, is independent of frequency for frontal sound incidence. During the transmission of the dummy-head signals equalized in this manner the test person receives a largely natural auditory impression due to the external-ear-type transfer characteristic of the headphones with free-field equalization. A further advantage consists in that the dummy-head signals, which are matched to the free sound field (equalized) by means of the process according to the invention, convey a greatly improved auditory impression also with reproduction by means of loudspeakers as was found by practical tests.

Figure 2:
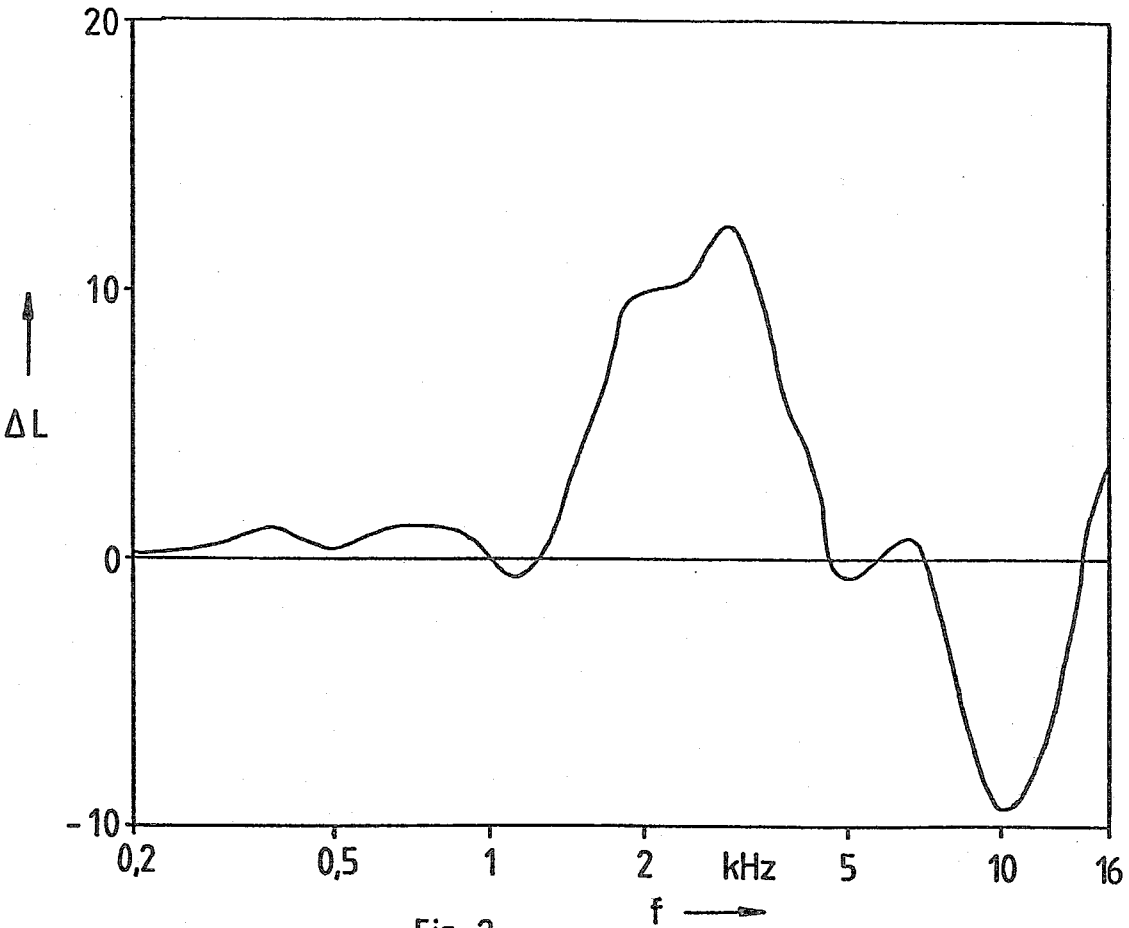
FIG. 2 shows the frequency response of the free-field transfer constant of the outer ear for frontal sound incidence, which corresponds to the frequency response of the transfer constant of headphones with free-field equalization according to DIN 45500.
Figure 3:
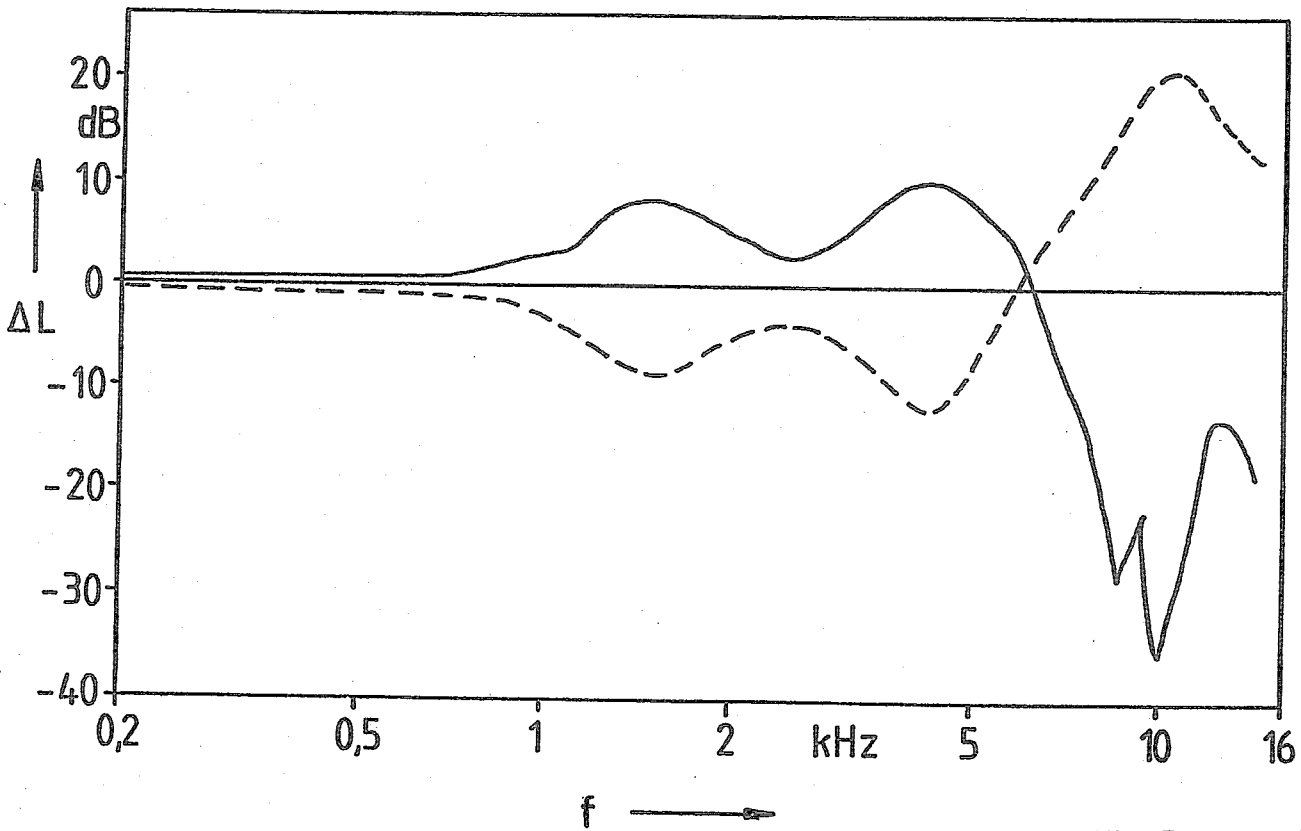
FIG. 3 shows the frequency responses of the free-field transfer constant of a known dummy head for frontal sound incidence (curve drawn as a continuous line) and of the transfer constant of the filter arrangement provided in accordance with the invention (curve drawn as a dashed line)
Figure 4:
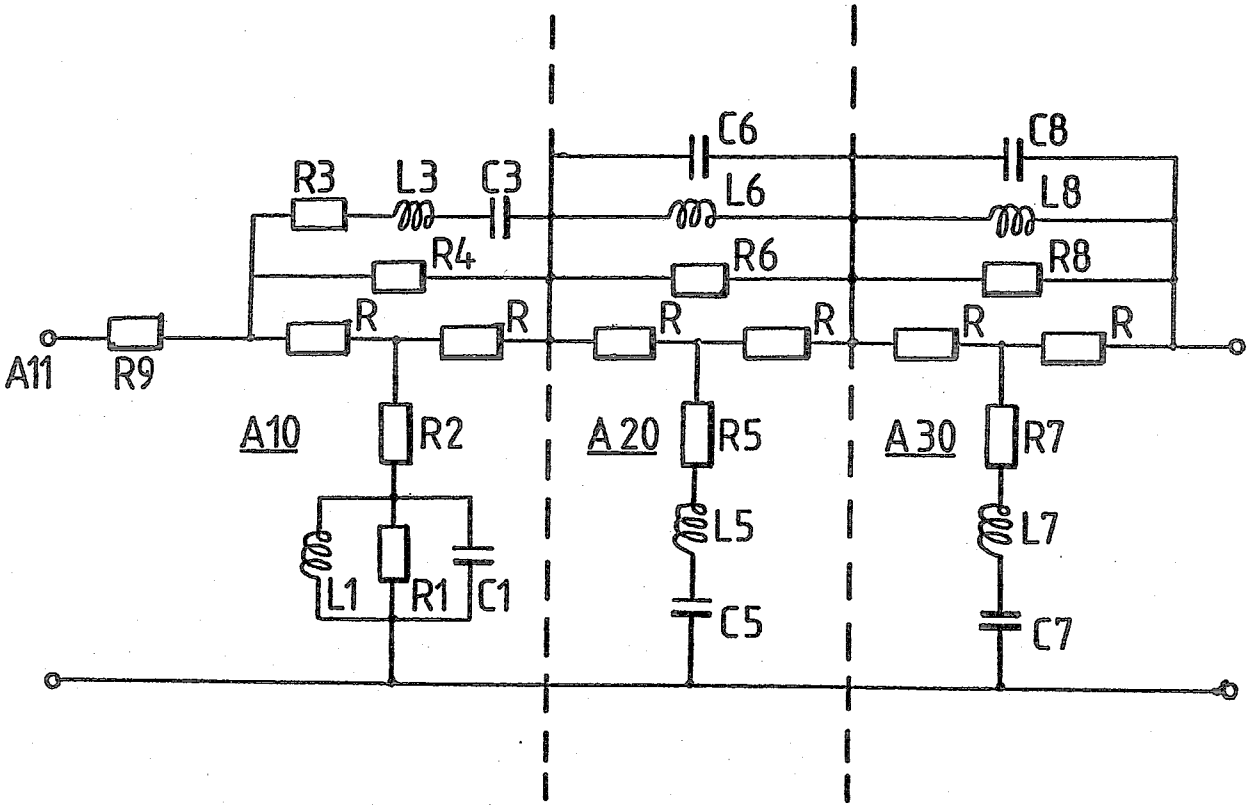
FIG. 4 shows an electric circuit diagram of an illustrative embodiment of the filter arrangement provided in accordance with the invention.

This part of the invention is explained in greater detail with the aid of FIGS. 2 to 4.

In order to illustrate the problems expounded already at the beginning, FIG. 2 shows the frequency response of the transfer constant for headphones D with free-field equalization and FIG. 3 that for a dummy head according to German Pat. No. 19 27 401. As can be seen from a comparison of the two frequency responses, with iterative connection of dummy head and headphones the addition of the frequency responses results in strong peaking of the resultant frequency response and thus in an unnatural auditory impression. The concept forming the basis of the present invention now consists in compensating the frequency response of the dummy head for frontal sound incidence at the pick-up side with the aid of a filter arrangement A2 as is indicated in FIG. 3 by the curve drawn in dashes. The result of this measure is that in the transmission chain from the dummy head A to the headphones D for frontal sound incidence only the frequency response, simulated by the headphones, of the free-field transfer constant of the outer ear according to FIG. 2 is still effective so that the test person receives a largely natural auditory impression.

The filter arrangement A2, provided for carrying out the process according to the invention and represented in FIG. 4 with the aid of an illustrative embodiment, consists of the iterative connection of a band-pass filter A10 and two band-rejection filters A20 and A30, the circuit components A10, A20 and A30 being separated from each other by vertical dashed lines. The band-pass filter A10 and the band-rejection filters A20 and A30 are constructed in the form of bridged-T networks. The shunt arm of the band-pass filter A10 comprises a parallel resonant circuit including an inductor $L_1$, a capacitor $C_1$ and an ohmic resistor $R_1$ and a series resistor $R_2$. The bridge arm of the band-pass filter A10 comprises a series resonant circuit including an inductor $L_3$, a capacitor $C_3$ and an ohmic resistor $R_3$ and a parallel resistor $R_4$. The series arm of the band-pass filter A10 comprises two ohmic resistors R. This applies in an identical manner also to the series arms of the two band-rejection filters A20 and A30.

At the first band-rejection filter A20 the shunt arm comprises a series resonant circuit including an inductor $L_5$, a capacitor $C_5$ and an ohmic resistor $R_5$. The bridge arm of the band-rejection filter A20 comprises a parallel resonant circuit including an inductor $L_6$, a capacitor $C_6$ and an ohmic resistor $R_6$.

At the second band-rejection filter A30 the shunt arm comprises a series resonant circuit including an inductor $L_7$, a capacitor $C_7$ and an ohmic resistor $R_7$. The bridge arm of the band-rejection filter A30 comprises a parallel resonant circuit including an inductor $L_8$, a capacitor $C_8$ and an ohmic resistor $R_8$.

For impedance matching purposes, the input A11 of the filter arrangement of FIG. 4 is preceded by an ohmic resistor $R_9$.

A filter arrangement A2 according to FIG. 4, which was implemented in practice, had an insertion loss of 37 dB for a wide-band signal. Due to the fact that passive components were used exclusively, the filter arrangement A2 of FIG. 4 had practically no inherent noise.

The action of the filter arrangement A2 of FIG. 4 can be best seen from the frequency response of FIG. 3 (curve drawn dashed). The band-pass filter A10 causes the frequency response to peak at 10 kHz and the band-rejection filters A20 and A30 cause the dips at 1.4 kHz and 4.2 kHz, respectively.

The process described up to now can be used only if it is assumed that the headphones used have free-field equalization for frontal sound incidence. The partial object of making the process applicable also for headphones which have free-field equalization also with respect to other directions of sound incidence, is achieved if the frequency response of the filter arrangement A2 is inverse with respect to the free-field transfer constant of the dummy head A, A1 for this other direction of sound incidence.

A filter arrangement A2 which is suitable for carrying out the modified process is one in which the frequency response of the filter arrangement is inverse with respect to the free-field transfer constant of the dummy head for the direction of sound incidence for which the headphones are provided with free-field equalization.

The modified process takes into consideration the other direction of sound incidence in the free-field equalization of the headphones by the fact that the frequency response of the matching filter A2 is inverse to the free-field transfer constant of the dummy head for the other direction of sound incidence. With this design of the matching filter A2 the listener receives natural auditory signals even if the headphones D used do not have free-field equalization for frontal sound incidence in accordance with DIN 45500, Part 10 of September 1975.

Figure 5:
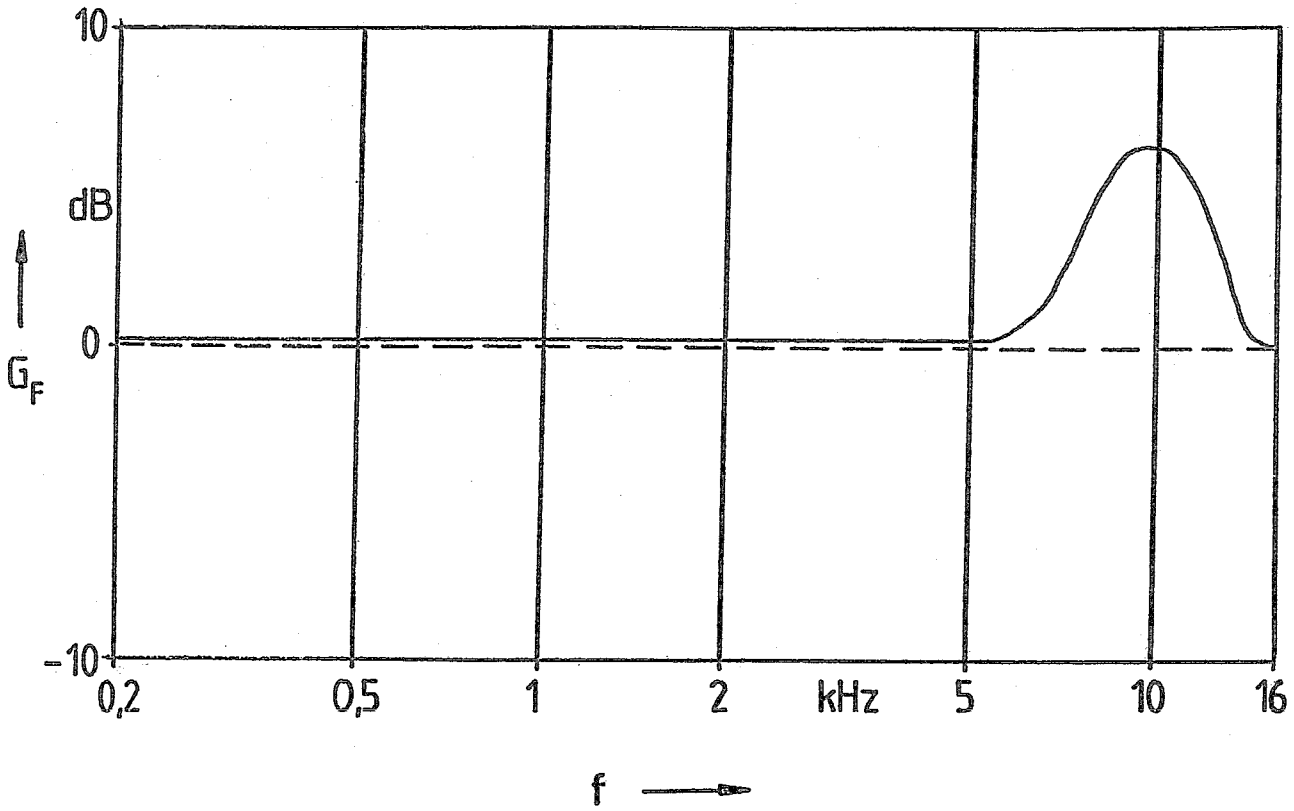
FIG. 5 shows the frequency response of headphones with free-field equalization for a different direction of sound incidence (curve drawn as a continuous line) and that of headphones with free-field equalization according to DIN 45500 (curve drawn as dashed line)
Figure 6:
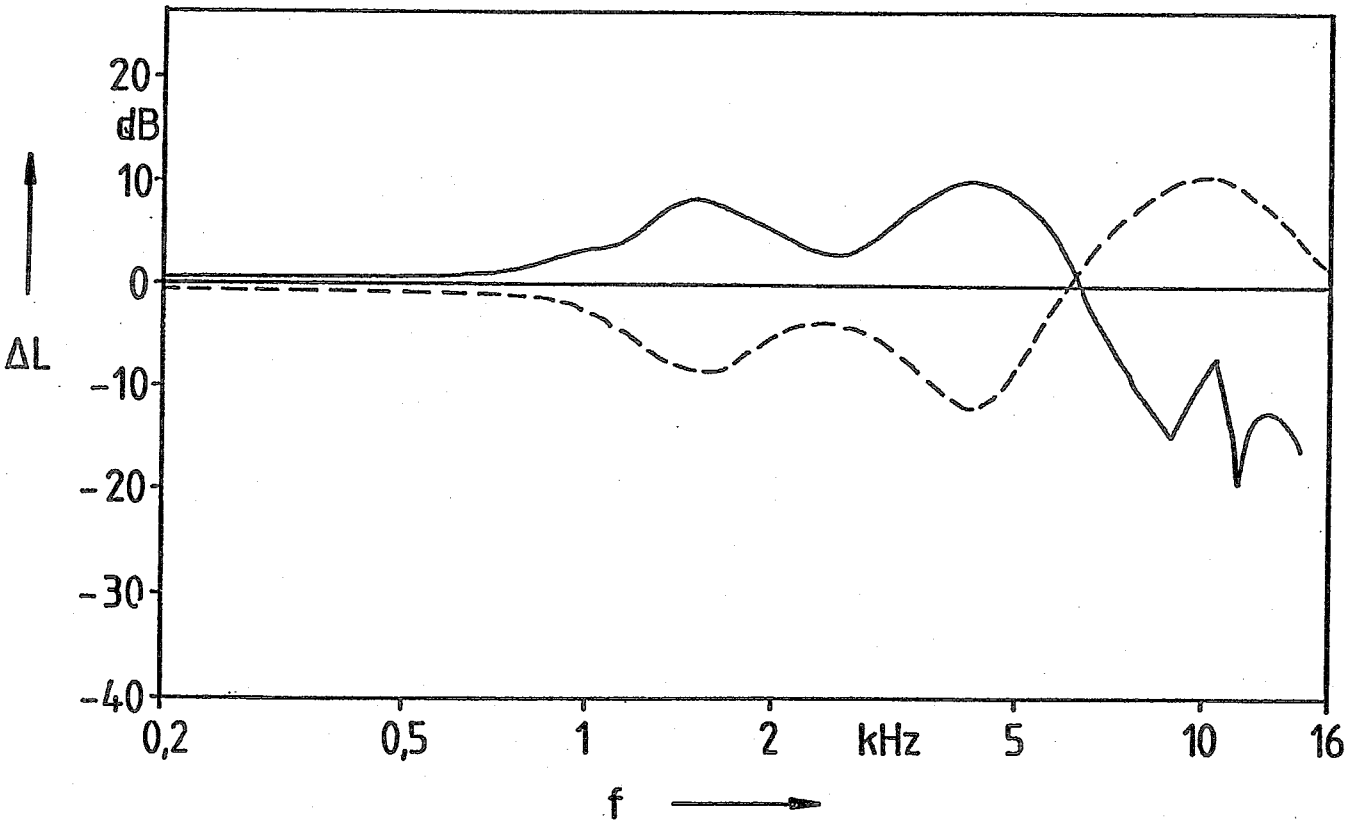
FIG. 6 shows the frequency response of the sum of the free-field transfer constants of a known dummy head for frontal sound incidence according to FIG. 3 and the headphones, used as basis in FIG. 5, with deviating free-field equalization (curve drawn as continuous line) and the frequency response of the transfer constant of the filter arrangement provided in accordance with the invention (curve drawn as dashed line)

This part of the invention is explained in greater detail with the aid of FIGS. 5 and 6.

For purposes of illustration, FIG. 5 shows the different frequency responses $G_F$ of headphones with frontal free-field equalization or with free-field equalization deviating from this. As can be seen from this Figure, the headphones indicated with a continuous curve have, in contrast to the headphones indicated with a dashed curve and provided with free-field equalization in a known manner, a peak at a frequency of approximately 10 kHz. The sum of this frequency response and the frequency response of a dummy head of the type KU 80 by Neumann GmbH, Berlin, results in the frequency response shown in FIG. 6 with a continuous line. Now, the concept forming the basis of the modified process consists in that this sum of the frequency responses of dummy head and headphones with deviating reference direction of the free-field equalization is compensated at the pick-up side with the aid of a filter arrangement as indicated in FIG. 6 with the curve drawn dashed.

As a result of this measure the frequency response of the free-field transmission constant of the outer ear for the selected direction of sound incidence becomes effective in the transmission chain from the dummy head A to the headphones D so that the listener receives a natural auditory impression even if the reference direction is changed.

The filter arrangement A2 represented in FIG. 4 is also suitable for carrying out the modified process.

In the application, described initially, of the process of free-field matching to the known dummy head by Neumann GmbH, Berlin, the compensation in the opposite direction of the transfer function of the dummy head is achieved with the aid of a filter arrangement A2 which consists of the iterated connection of a band-pass filter and two band-rejection filters. Apart from the constructional effort for this filter arrangement A2, this results in a frequency-dependent attenuation of the stereophonic signals by more than 30 dB (measured over the whole bandwidth) which must be compensated again by appropriate amplification. Since with this amplification the microphone hiss is also amplified, the background noise of the resultant signal increases overall in a frequency-dependent manner. This the microphone hiss at high frequencies becomes clearly audible.

The partial object of achieving an improvement in the signal/noise ratio with the process is also achieved by the invention.

Constructionally particularly favorable development of a dummy head is one in which in the dummy head the filter arrangement is installed, together with a preceding amplifier A3 and the power supply.

The further development is based on the concept of using for the dummy head A microphones A1 which together with the characteristics of the dummy head have a frequency response which has only peaks and no dips. The filter arrangement A2 thus needs to filter out only the peaks, which results not only in the desired linearization of the useful signal over the whole frequency range but also in an attenuation of the noise components in the frequency range in which the useful signal is peaking. For this reason there is no need for subsequent amplification of the filtered stereophonic signals to compensate for the filter attenuation and the background noise is reduced overall. In order to obtain a frequency response of the dummy head/microphones system which only has peaks, according to the invention microphones A1 are used which have a resonant point in the frequency range between 5 and 12 kHz. For this, electret microphones or condenser microphones may be used. For the filter arrangement A2 for filtering out the remaining peaks a passive band-rejection filter can be used. All components, such as the amplifier A3, the filter arrangement A2 and the power supply, can be advantageously installed in the dummy head, which results in simple and clear handling.

This part of the invention is explained in greater detail with the aid of FIGS. 7 to 10.

Figure 7:
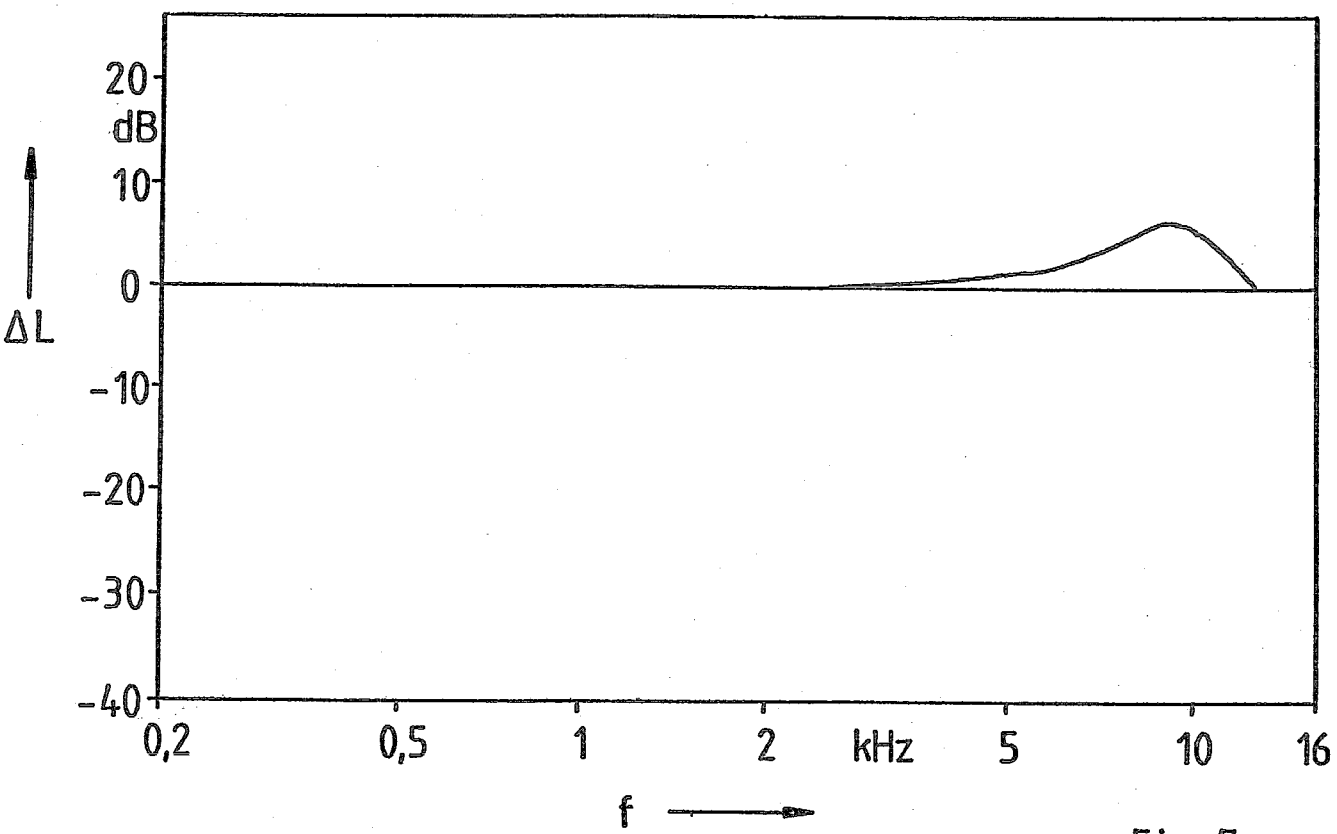
Fig. 7 PRIOR ART
FIG. 7 shows the frequency response of a known electret microphone provided for carrying out the process according to the invention.
Figure 8:
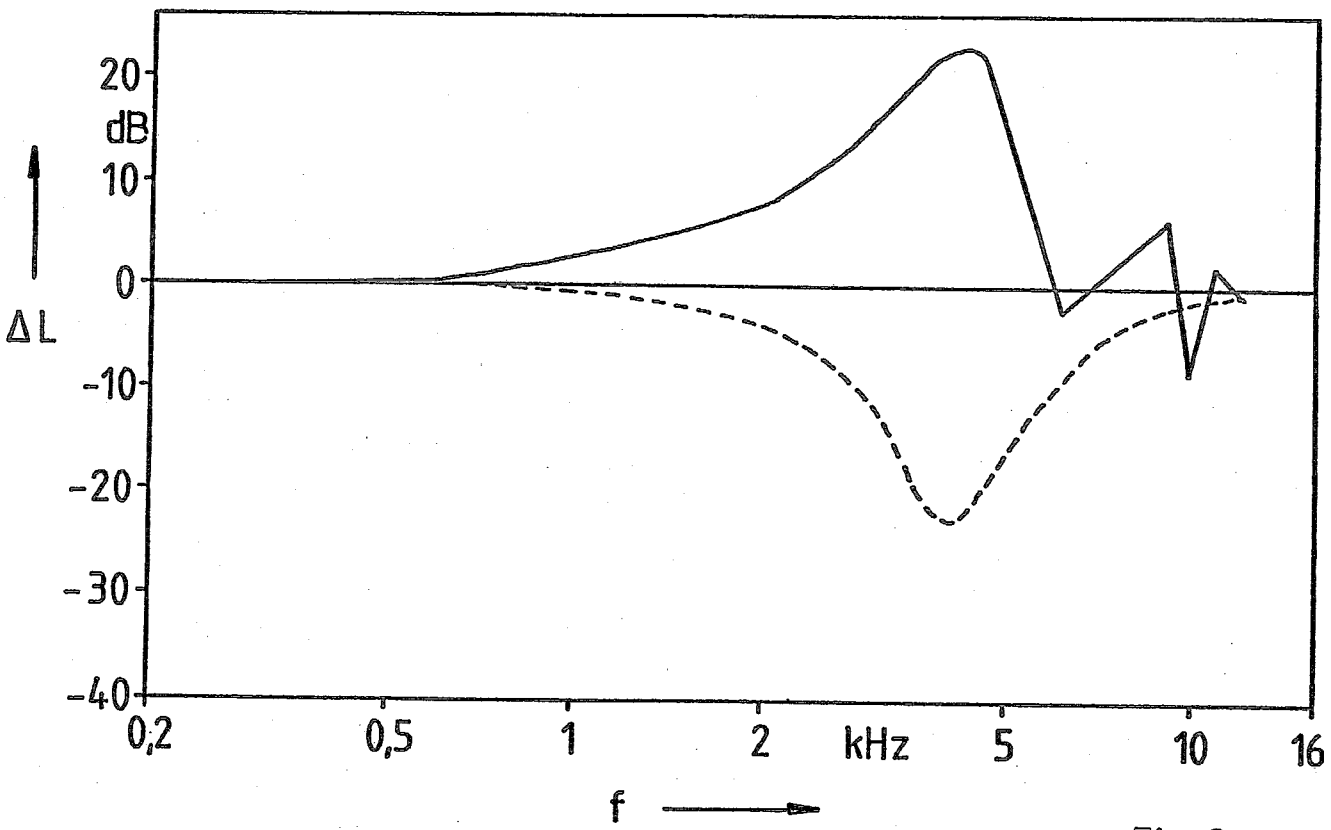
FIG. 8 shows the frequency response of the free-field transfer constant of a new dummy head which is equipped with two electret microphones, with frontal sound incidence (curve drawn as a continuous line) and the transfer constant of the filter arrangement provided in accordance with the invention (curve drawn as a dashed line)

The curve shown in FIG. 7 shows the frequency response of a known electret microphone which has a resonant peak in the range between 2 and 12 kHz. The resonant point has been selected in such a manner that it matches the respective dummy head used. If two electret microphones, illustrated in FIG. 7 with their frequency response, are installed in a new dummy head, the frequency response, drawn in FIG. 8 with a continuous line, of the free-field transfer constant for frontal sound incidence is produced. As can be seen from this, this frequency response has essentially only one peak with a maximum at about 4 kHz. The overshoots adjacent to this peak in both directions can be neglected. The peak shown can be filtered out with the aid of a filter arrangement A2 which has the frequency response shown in FIG. 8 as a dashed line. A suitable filter arrangement A2 is, for example, the passive band-rejection filter illustrated in FIG. 9 which has a T arm and a bridge arm $R_{11}$, $L_{11}$, $C_{11}$ and, for impedance matching, a preceding series resistor $R_9$ and a following parallel resistor R. The T arm comprises in its series section two series resistors R and in its shunt section a series LC circuit $L_{10}$, $C_{10}$ which is loaded by a series resistor $R_{10}$. The bridge arm of the filter arrangement according to FIG. 9 consists of a parallel LC circuit $L_{11}$, $C_{11}$ which is loaded by a parallel resistor $R_{11}$.

Figure 10:
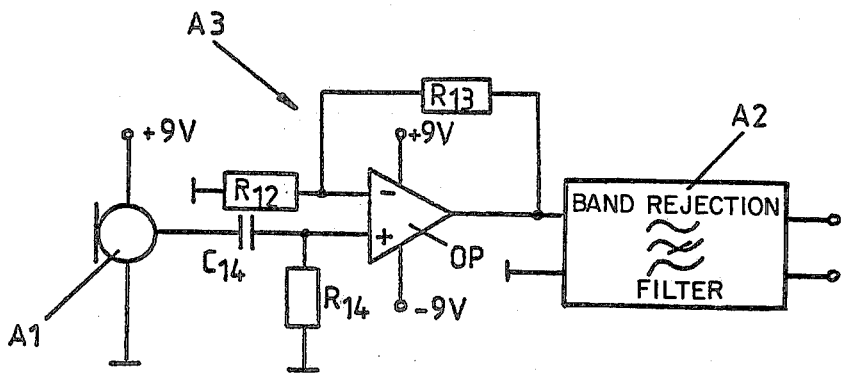
FIG. 10 shows an electric circuit of the components, installed in a dummy head, for carrying out the process according to the invention.

FIG. 10 shows a signal arm for processing a stereophonic L or R signal, this signal arm consisting of the iterative connection of a microphone A1, a high-pass filter $R_{14}$, $C_{14}$, an operational amplifier OP and the filter arrangement A2. In a preferred embodiment, two such signal arms are constructionally integrated together with the required power supply (for example a battery) in the dummy head so that a clear sound pick-up device which is easy to handle is made available. As the microphone A1 an electret microphone with a frequency response according to FIG. 7 or a condenser microphone with a comparable frequency response is provided. The high-pass filter $R_{14}$, $C_{14}$, which is arranged between the microphone A1 and the non-inverting input of the operational amplifier OP, consists of a series capacitor $C_{14}$ and a shunt resistor $R_{14}$ and is used for filtering out low-frequency noise signals picked up by the microphone A1 from the environment of the sound source of interest. The inverting input of the operational amplifier OP is connected to a series resistor $R_{12}$ for setting its gain. The amplifier output is fed back via a feedback resistor $R_{13}$ to the inverting input of the operational amplifier OP. The filter arrangement A2 is, for example, the embodiment shown in FIG. 9 with a passive band-rejection filter.

A DEVICE B FOR PICKING UP SIGNALS WHICH ARE STEREOPHONIC IN A SPACE-RELATED MANNER

For picking up stereophonic signals which are intended for space-related reproduction, that is to say for reproduction by means of stationary loudspeakers, stereophonic microphone arrangements of different types can be used which have the common feature that the distance between the two microphones is small with respect to the distance of the microphone arrangement from the sound sources. Such microphone arrangements can be generally described by their directional pattern $\vec{A}(f, \phi, \delta) = (A_{li}(f, \phi, \delta), A_{re}(f, \phi, \delta))$, where $A_{li}$ and $A_{re}$ are the free-field transfer functions of the left and right microphone, respectively, which generally depend on the frequency f, the azimuth angle $\phi$ with respect to a reference direction and on the angle of elevation $\delta$ above the horizontal plane. The directional pattern $\vec{A}$ (f, $\phi$, $\delta$) of the microphone is independent of the distance of the sound sources if, in accordance with the assumptions, the distance of the sound sources is great with respect to the dimensions of the microphone arrangement.

The stereophonic loudspeaker arrangements for the reproduction of signals which are stereophonic in a space-related manner have the common feature that the distance between the two loudspeakers and the location of the listener is great with respect to the diameter of the listener's head and the loudspeaker dimensions. Practical significance is given to loudspeaker set-ups which are arranged symmetrically about the center with respect to the position of the listener's head and have a basis which is a few meters wide and has an angle of about 60°. The effect of such stereophonic loudspeaker arrangements at the location of the listener is not too live an environment can be generally described by the free-field transfer function $C_1$ (f) and $C_2$ (f) and by the direction of installation $\phi_1$, $\delta_1$ and $\phi_2$, $\delta_2$ of the two loudspeakers. Here $\phi_1$ and $\phi_2$, respectively, are the azimuth angles with respect to a reference direction and $\delta_1$ and $\delta_2$, respectively, are the angles of elevation above the horizontal plane in each case for the first and second loudspeaker, respectively, with respect to the location of the listener.

Filters with the inverse transfer functions $1/C_1$ (f) and $1/C_2$ (f), which can be connected before the two loudspeakers, can always be used to ensure that the free-field transfer functions of the loudspeaker arrangement with respect to the location of the listener are independent of frequency and the difference in time delay to the location of the listener is compensated. The effect of the loudspeakers then only depends on the directions of installation $\phi_1$, $\delta_1$ and $\phi_2$, $\delta_2$. As is well known, during the reproduction of the signals, picked up via stereophonic microphone arrangements, by means of the above-mentioned loudspeaker arrangements the tone quality, localization and temporal perception of the individual original sound sources are strongly falsified which has led to additional support microphones and multi-channel mixing consoles being used for high-quality recordings of spatially distributed sound sources.

The partial object of achieving with a sound pick-up installation, which has only two microphone channels, a sound pick-up of space-related signals with tonal, directional and temporal fidelity in a simple manner is achieved in accordance with the present invention by a device comprising a decoupling arrangement B10 to which the signals of the microphone channels 20, 30 are fed and in which in series arms B11, B12 of a left transmission channel $M_{li}$, $L_1$ and of a right transmission channel $M_{re}$, $L_2$ in each case a subtraction element B13 and B14, respectively, is arranged which is followed by a transmission element B15 and B16, respectively, and in which in shunt arms, which provide reverse feedback from the output $L_1$ of the left transmission channel $M_{li}$, $L_1$ to the negative input of the subtraction element B14 arranged in the series arm B12 of the right transmission channel $M_{re}$, $L_2$ and from the output $L_2$ of the right transmission channel $M_{re}$, $L_2$ to the negative input of the subtraction element B13 arranged in the series arm B11 of the left transmission channel $M_{li}$, $L_1$, in each case a feedback element B17, B18 is contained, wherein the transmission element B15 in the series arm B11 of the left transmission channel $M_{li}$, $L_1$ simulates the inverse free-field transfer function of the left microphone channel 20 for the direction of sound incidence $\phi_1$, $\delta_1$ corresponding to the direction of installation of a first loudspeaker 40, wherein the transmission element B16 in the series arm B12 of the right transmission channel $M_{re}$, $L_2$ simulates the inverse free-field transfer function of the right microphone channel 30 for the direction of sound incidence $\phi_2$, $\delta_2$ corresponding to the direction of installation of a second loudspeaker 50, wherein the feedback element B18 providing reverse feedback from the output $L_2$ of the right transmission channel $M_{re}$, $L_2$ simulates the free-field transfer function of the left microphone channel 20 for the direction of sound incidence $\phi_2$, $\delta_2$ corresponding to the direction of installation of the second loudspeaker 50, and wherein the feedback circuit B17 providing reverse feedback from the output $L_1$ of the left transmission channel $M_{li}$, $L_1$ simulates the free-field transfer function of the right microphone channel 30 for the direction of sound incidence $\phi_1$, $\delta_1$ corresponding to the direction of installation of the first loudspeaker 40.

It is advantageous to arrange in the left and right transmission channels $M_{li}$, $L_1$ and $M_{re}$, $L_2$, respectively, before and/or after the decoupling arrangement B10, which is reduced by separable parts of its total transfer function, further transmission elements B61, B71 and B62, B72, the transfer functions of which contain the separated parts of the total transfer function of the decoupling arrangement B10.

The separated transmission elements B61 and B62, arranged before the subtraction elements B13* and B14* of the reduced decoupling arrangement B10*, are preferably designed as microphone equalizers A2 for the microphones A1 located in the sound pick-up channels 20 and 30.

In the device B according to the invention, the signals $M_{li}$ and $M_{re}$ from only two microphone channels 20 and 30 are converted during the pick-up process by means of a decoupling arrangement B10 in such a manner that during the reproduction by means of loudspeakers of the converted signals $L_1$, $L_2$ the auditory event reproduced corresponds to the original, spatially-distributed auditory event with tonal, temporal and directional fidelity. In comparison to the sound pick-up device mentioned initially, which has additional support microphones and multi-channel mixing consoles, the arrangement of the two microphone channels 20 and 30 and the decoupling arrangement B10 is much less elaborate, the quality of reproduction achieved with the aid of the device B according to the invention being at least equal to and perhaps even better than this state of the art as has been shown by practical trials. This applies particularly in the case where the two microphones are arranged in a dummy head A because the stereophonic signals then contain the natural spatial information.

Figure 11:
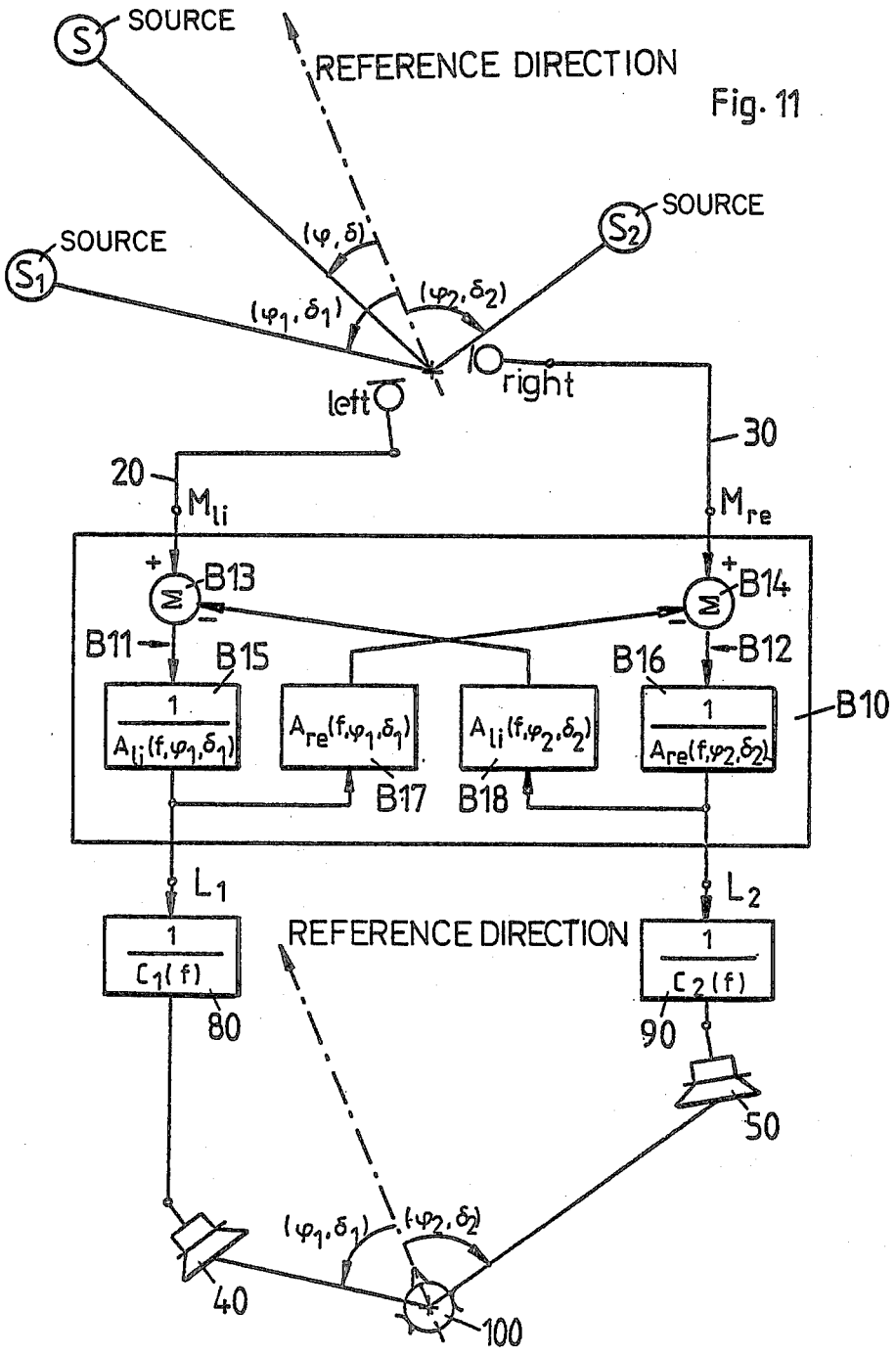
FIG. 11 shows a block diagram of a general illustrative embodiment of a sound pick-up and reproduction device which is constructed in accordance with the invention and is stereophonic in a space-related manner and which is provided with a decoupling arrangement.
Figure 12:
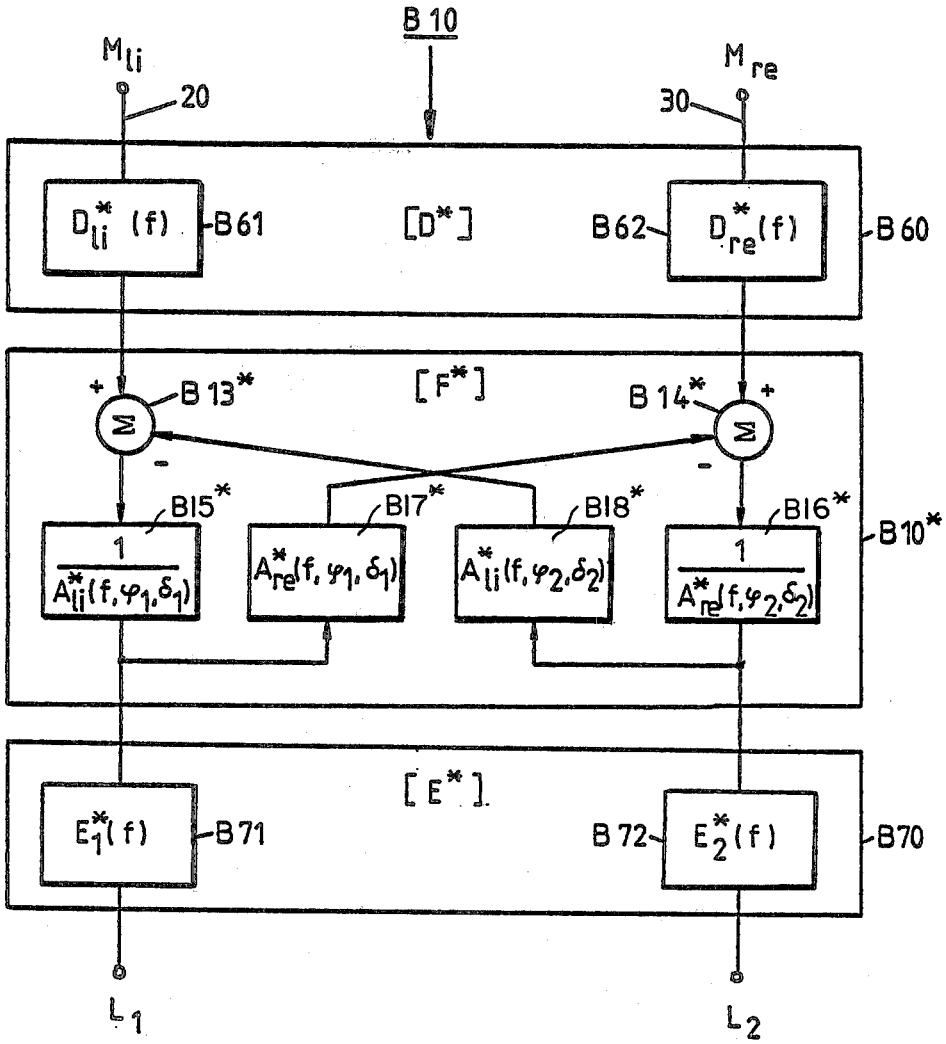
FIG. 12 shows a block diagram of a decoupling arrangement which can be used as an alternative in the device of FIG. 11.

This part of the invention is explained in greater detail with the aid of FIGS. 11 and 12.

The device of FIG. 11 comprises, at the sound pick-up side, two microphone channels 20 and 30, the signals of which are fed to the inputs $M_{li}$ and $M_{re}$ of a decoupling arrangement B10. The decoupled signals at the outputs $L_1$ and $L_2$ of the decoupling arrangement B10 can be recorded on a suitable two-channel recording medium or transmitted via separate radio sound channels. On the receiving side, for the two transmission or sound channels two loudspeakers 40 and 50 are provided for reproduction which is stereophonic in a space-related manner and these loudspeakers can be preceded by transmission elements 80 and 90, respectively, in order to achieve a sound transformation which is independent of frequency and delay time. With reference to the head 100 of a listener, the loudspeakers 40 and 50 have the azimuth angles $\phi_1$ and $\phi_2$, respectively, and the angles of elevation $\delta_1$ and $\delta_2$. In addition, with respect to the two microphone channels 20 and 30, the general case of the recording of a sound source S is illustrated with a direction of sound incidence $\phi$, $\delta$ referred to an optional reference direction, drawn in dot-dashes, and the case of two sound sources $S_1$ and $S_2$ with the special directions of sound incidence $\phi_1$, $\delta_1$ and $\phi_2$, $\delta_2$ in FIG. 11.

The decoupling arrangement B10 comprises four special transmission elements B15, B16, B17 and B18, the transfer functions of which are still to be explained in greater detail hereinafter. The transmission elements B15, B16, B17 and B18 are connected together in the form of an inverse filter, the transmission element B15 being arranged in the series arm B11 of the left-hand transmission channel and the transmission element B16 in the series arm B12 of the right-hand transmission channel. Between the inputs $M_{li}$ and $M_{re}$ and the transmission elements B15 and B16, respectively, in each case a subtraction element B13 and B14 is provided. The negative input of the subtraction element B13 is connected via the transmission element B18 to the output of the transmission element B16 and output $L_2$ in the sense of a reverse feedback and the negative input of the subtraction element B13 is connected via the transmission element B17 to the output of the transmission element B15 and output $L_1$ in the sense of a reverse feedback. The decoupling arrangement B10 causes the microphone signals $\vec{M}=(M_{li}, M_{re})$ to be decoupled in such a manner that the loudspeaker signals $\vec{L}=(L_1,L_2)$, which are thereby generated, separately contain all the sound information items from the special directions $\phi_1$, $\delta_1$ and $\phi_2$, $\delta_2$. It is generally not necessary for the loudspeakers 40 and 50 to be symmetrical.

For practical applications, the principle of using two loudspeakers corresponding to the DIN standard and set up in standard stereo arrangement can be applied on the reproduction side. Since these loudspeakers are then at the same distance from the listener's position and have the same free-field transfer function, which is sufficiently independent of frequency, the transmission elements 80 and 90 can be omitted. In the standard type of installation, the azimuth angles are $\phi_1=-30°$ and $\phi_2=+30°$ and the angles of elevation are $\delta_1=\delta_2=0°$. For these two directions of sound incidence the free-field functions of the left and right microphone channel 20 and 30, respectively, must then be known in order to be able to calculate the decoupling arrangement B10.

For the three stereophonic microphone arrangements which are of significance in practice, Table 1 lists the transfer function [F] of the decoupling arrangement B10. In the normal case the microphones are arranged symmetrically about the center so that the describing matrices, therefore, are symmetrical with respect to the main diagonal.

In the generalized embodiment, shown in FIG. 12, of a decoupling arrangement, in the left and right transmission channels $M_{li}$, $L_1$ and $M_{re}$, $L_2$, respectively, before and after the "reduced" decoupling arrangement, here called B10*, further transmission elements B61, B71 and B62, B72 are arranged. The transfer functions of these further transmission elements B61, B71 and B61, B72, that is to say $D_{li}^*(f)$, $E_1^*(f)$, $D_{re}^*(f)$ and $E_2^*(f)$, contain separated parts of the total transfer function [F] of the decoupling arrangement B10 according to FIG. 11. Accordingly, by the expression, "reduced" decoupling arrangement, is meant the remainder of the decoupling arrangement B10 of FIG. 11, reduced by the separated-off parts of the total transfer function, which therefore, is called B10* in FIG. 12. As far as their structure is concerned, the decoupling arrangement B10 of FIG. 11 and the reduced decoupling arrangement B10* of FIG. 12 only differ by the respective transfer function of the transmission elements B15, B16, B17 and B18, as is explained in detail hereinafter.

The transmission elements B61 and B62 arranged before the inputs of the reduced decoupling arrangement B10* having the transfer function [F*] have the transfer function $$[D^*] = \begin{bmatrix} D_{li}^*(f) & 0 \\ 0 & D_{re}^*(f) \end{bmatrix},$$

and the transmission elements B71 and B72 indicated as following the outputs of the reduced decoupling arrangement B10* have the transfer function $$[E^*] = \begin{bmatrix} E_1^*(f) & 0 \\ 0 & E_2^*(f) \end{bmatrix}$$

The reduced decoupling arrangement B10* then has the transfer function [F*]:

$$[F^*] = [A^*]^{-1} = \begin{bmatrix} A_{li}^*(f,\phi_1,\delta_1) & A_{li}^*(f,\phi_2,\delta_2) \\ A_{re}^*(f,\phi_1,\delta_1) & A_{re}^*(f,\phi_2,\delta_2) \end{bmatrix}^{-1}$$

$$= \begin{bmatrix} A_{li}(f,\phi_1,\delta_1)\cdot D_{li}^*(f)\cdot E_1^*(f) & A_{li}(f,\phi_2,\delta_2)\cdot D_{li}^*(f)\cdot E_2^*(f) \\ A_{re}(f,\phi_1,\delta_1)\cdot D_{re}^*(f)\cdot E_1^*(f) & A_{re}(f,\phi_2,\delta_2)\cdot D_{re}^*(f)\cdot E_2^*(f) \end{bmatrix}^{-1}$$

Iterative connection of the three transmission blocks B60, B10* and B70 having the transfer functions [D*], [F*] and [E*], again yields the desired decoupling function $[F]=[A]^{-1}$:

$$[F] = [D^*] \times [F^*] \times [E^*]$$

$$= \begin{bmatrix} D_{li}^*(f) & 0 \\ 0 & D_{re}^*(f) \end{bmatrix} \cdot$$

$$\begin{bmatrix} A_{li}(f,\phi_1,\delta_1)\cdot D_{li}^*(f)\cdot E_1^*(f) & A_{li}(f,\phi_2,\delta_2)\cdot D_{li}^*(f)\cdot E_2^*(f) \\ A_{re}(f,\phi_1,\delta_1)\cdot D_{re}^*(f)\cdot E_1^*(f) & A_{re}(f,\phi_2,\delta_2)\cdot D_{re}^*(f)\cdot E_2^*(f) \end{bmatrix}^{-1} \cdot$$

$$\begin{bmatrix} E_1^*(f) & 0 \\ 0 & E_2^*(f) \end{bmatrix}$$

and after the matrix [F*] is spilt up, [F] is obtained as follows:

$$[F] = \begin{bmatrix} D_{li}^*(f) & 0 \\ 0 & D_{re}^*(f) \end{bmatrix} \cdot \begin{bmatrix} D_{li}^*(f) & 0 \\ 0 & D_{re}^*(f) \end{bmatrix}^{-1} \cdot$$

$$\begin{bmatrix} A_{li}(f,\phi_1,\delta_1) & A_{li}(f,\phi_2,\delta_2) \\ A_{re}(f,\phi_1,\delta_1) & A_{re}(f,\phi_2,\delta_2) \end{bmatrix}^{-1} \cdot \begin{bmatrix} E_1^*(f) & 0 \\ 0 & E_2^*(f) \end{bmatrix}^{-1} \cdot \begin{bmatrix} E_1^*(f) & 0 \\ 0 & E_2^*(f) \end{bmatrix}$$

$$= \begin{bmatrix} 1 & 0 \\ 0 & 1 \end{bmatrix} \cdot [A]^{-1} \cdot \begin{bmatrix} 1 & 0 \\ 0 & 1 \end{bmatrix} = [A]^{-1}$$

Table 2 contains the seven types of reproduction possible for the decoupling arrangement B60, B10* and B70 of FIG. 12 which are generated by making certain pairs of transfer functions equal to one. The first line of Table 2 contains the case, shown in FIG. 11, of the decoupling arrangement B10 which is distinguished by the fact that all the transmission elements B61, B71, B62 and B72 preceding and following the decoupling arrangement have a transfer function of one. All the decoupling arrangements of Table 2 are equivalent with respect to the transfer function [F] but not with respect to their constructional design.

TABLE 1

| Microphone Arrangement | Stereophonic Coincidence Microphone | Stereophonic Delay-line Microphone | Dummy Head |
|---|---|---|---|
| Directional differences between the left and the right microphone signal | Pure level differences, e.g. L = 20 dB for $-\phi_1 = \phi_2 = 30°$ | Pure delay differences, e.g. $\Delta\tau = 200\ \mu s$ for $-\phi_1 = \phi_2 = 30°$ | Spectral differences (shading of high frequencies) and delay differences K(f) as with natural hearing. |

TABLE 1-continued

| Microphone Arrangement | Stereophonic Coincidence Microphone | Stereophonic Delay-line Microphone | Dummy Head |
|---|---|---|---|
| Matrix [A] of the four free-field transfer functions of microphones 20, 30 | $[A] = \begin{bmatrix} 1 & 0{,}1 \\ 0{,}1 & 1 \end{bmatrix}$ | $[A] = \begin{bmatrix} 1 & e^{-j\omega\Delta\tau} \\ e^{-j\omega\Delta\tau} & 1 \end{bmatrix}$ | $[A] = \begin{bmatrix} K_{-30°}(f) & K_{+30°}(f) \\ K_{+30°}(f) & K_{-30°}(f) \end{bmatrix}$ |
| Transfer function [F] of the decoupling arrangement 10 | $[F] = \begin{bmatrix} 1 & 0{,}1 \\ 0{,}1 & 1 \end{bmatrix}^{-1}$ | $[F] = \begin{bmatrix} 1 & e^{-j\omega\Delta\tau} \\ e^{-j\omega\Delta\tau} & 1 \end{bmatrix}^{-1}$ | $[F] = \begin{bmatrix} K_{-30°}(f) & K_{30°}(f) \\ K_{30°}(f) & K_{-30°}(f) \end{bmatrix}^{-1}$ |
| Implementation of the transfer function [F] | Attenuators in the feedback arms | Delay elements in the feedback arms | Frequency-dependent attenuators and delay elements |

TABLE 2

| Equivalence | Part-matrices [D*] | [F*] = [A*]$^{-1}$ | [E*] |
|---|---|---|---|
| 1 | $\begin{bmatrix} 1 & 0 \\ 0 & 1 \end{bmatrix}$ | $\begin{bmatrix} A_{li}(f,\phi_1,\delta_1) & A_{li}(f,\phi_2,\delta_2) \\ A_{re}(f,\phi_1,\delta_1) & A_{re}(f,\phi_2,\delta_2) \end{bmatrix}^{-1}$ | $\begin{bmatrix} 1 & 0 \\ 0 & 1 \end{bmatrix}$ |
| 2 | $\begin{bmatrix} 1 & 0 \\ 0 & 1 \end{bmatrix}$ | $\begin{bmatrix} A_{li}(f,\phi_1,\delta_1)\cdot E_1(f) & A_{li}(f,\phi_2,\delta_2)\cdot E_2(f) \\ A_{re}(f,\phi_1,\delta_1)\cdot E_1(f) & A_{re}(f,\phi_2,\delta_2)\cdot E_2(f) \end{bmatrix}^{-1}$ | $\begin{bmatrix} E_1(f) & 0 \\ 0 & E_2(f) \end{bmatrix}$ |
| 3 | $\begin{bmatrix} D_{li}(f) & 0 \\ 0 & D_{re}(f) \end{bmatrix}$ | $\begin{bmatrix} A_{li}(f,\phi_1,\delta_1)\cdot D_{li}(f) & A_{li}(f,\phi_2,\delta_2)\cdot D_{li}(f) \\ A_{re}(f,\phi_1,\delta_1)\cdot D_{re}(f) & A_{re}(f,\phi_2,\delta_2)\cdot D_{re}(f) \end{bmatrix}^{-1}$ | $\begin{bmatrix} 1 & 0 \\ 0 & 1 \end{bmatrix}$ |
| 4 | $\begin{bmatrix} 1 & 0 \\ 0 & 1 \end{bmatrix}$ | $\begin{bmatrix} 1 & A_{li}(f,\phi_2,\delta_2)/A_{re}(f,\phi_2,\delta_2) \\ A_{re}(f,\phi_1,\delta_1)/A_{li}(f,\phi_1,\delta_1) & 1 \end{bmatrix}^{-1}$ | $\begin{bmatrix} 1/A_{li}(f,\phi_1,\delta_1) & 0 \\ 0 & 1/A_{re}(f,\phi_2,\delta_2) \end{bmatrix}$ |
| 5 | $\begin{bmatrix} 1/A_{li}(f,\phi_1,\delta_1) & 0 \\ 0 & 1/A_{re}(f,\phi_2,\delta_2) \end{bmatrix}$ | $\begin{bmatrix} 1 & A_{li}(f,\phi_2,\delta_2)/A_{li}(f,\phi_1,\delta_1) \\ A_{re}(f,\phi_1,\delta_1)/A_{re}(f,\phi_2,\delta_2) & 1 \end{bmatrix}^{-1}$ | $\begin{bmatrix} 1 & 0 \\ 0 & 1 \end{bmatrix}$ |
| 6 | $\begin{bmatrix} 1 & 0 \\ 0 & 1 \end{bmatrix}$ | $\begin{bmatrix} A_{li}(f,\phi_1,\delta_1)/A_{re}(f,\phi_1,\delta_1) & 1 \\ 1 & A_{re}(f,\phi_2,\delta_2)/A_{li}(f,\phi_2,\delta_2) \end{bmatrix}^{-1}$ | $\begin{bmatrix} 1/A_{re}(f,\phi_1,\delta_1) & 0 \\ 0 & 1/A_{li}(f,\phi_2,\delta_2) \end{bmatrix}$ |
| 7 | $\begin{bmatrix} 1/A_{li}(f,\phi_2,\delta_2) & 0 \\ 0 & 1/A_{re}(f,\phi_1,\delta_1) \end{bmatrix}$ | $\begin{bmatrix} A_{li}(f,\phi_1,\delta_1)/A_{li}(f,\phi_2,\delta_2) & 1 \\ 1 & A_{re}(f,\phi_2,\delta_2)/A_{re}(f,\phi_1,\delta_1) \end{bmatrix}^{-1}$ | $\begin{bmatrix} 1 & 0 \\ 0 & 1 \end{bmatrix}$ |

CIRCUIT ARRANGEMENT C FOR MATCHING A SPACE-RELATED STEREOPHONIC PROGRAM SIGNAL TO HEADPHONES D

This part of the invention relates to a circuit arrangement for matching a space-related stereophonic program signal to headphones, which is known as such. Circuit arrangements of this type have the aim of simulating the direct sound radiation of two stereo loudspeakers in order to use this method to create the same auditory events when using headphones as when using loudspeakers.

However, the known circuit arrangements are on the one hand very expensive and, on the other hand, are not accurate enough and thus not effective enough. The ratio of constructional effort for the circuit to improvement gained in headphone reproduction (for example when preventing so-called in-the-head localization) is low, so that the methiod has hitherto not been successful.

With respect to the required accuracy, it is known from Acoustica Vol. 29 (1973), pages 273–277, that in the simulation of stereophonic loudspeaker radiation the circuit arrangement before the headphones must in principle take into consideration the individual directional pattern of the listener. The extent and significance both of the differences in the directional pattern from listener to listener and of the asymmetry between the left ear and the right ear, however, have not been adequately noted and for this reason no technical device has been described which permits the characteristics of such a circuit arrangement to be matched to the individual auditory characteristics.

From U.S. Pat. No. 4,143,244 a circuit arrangement is known which compensates for differences between the listener's head and the dummy head used for the sound pick-up for frontal sound incidence. This circuit arrangement can also be used analogously for the individual simulation of acoustic irradiation by a frontally positioned loudspeaker. However, it is not able to simulate individually the acoustic irradiation by two loudspeakers positioned to the side, which is more important in practice. For instance, in this circuit arrangement the cross-coupling between the two space-related stereo signals at the listener's ears (including the interaural difference in time delays which depends on the size of the listener's head) is not taken into consideration.

In contrast to this, it is the object of this part of the invention to provide a circuit arrangement of the type mentioned initially which, whilst dispensing with the inessential, makes possible meaningful approximations and thus a simplification but simultaneously simulates the essential characteristics of loudspeaker radiation more accurately, that is to say individually correctly.

Within the context of the problems set, for example the free-field transfer constants of the loudspeakers to be simulated must be considered as inessential because it is of no significance for localization during loudspeaker reproduction. This is why this loudspeaker characteristic is also unimportant for the simulation of loudspeaker radiation with the aid of headphones so that it is sufficient in every case to refer to two "ideal" loudspeakers. With respect to another transfer characteristic it is even a disadvantage to hold on to the principle of an accurate simulation of stereophonic loudspeaker radiation because most of the stereophonic program signals have the peculiarity that, with stereophonic loudspeaker reproduction, frontal auditory events are reproduced elevated, that is to say they are reproduced above the loudspeaker base line. This characteristic should not be simulated, particularly since during headphone reproduction the auditory events show a strong tendency to elevation in any case.

On the other hand, it has been found that accurate simulation of the interaural level and delay differences for the lateral direction of loudspeaker positioning is essential for good localization. For this it is necessary to take into consideration the individual directional pattern of the listener, and do so separately for the left-hand and the right-hand direction of sound incidence.

The invention provides two methods for obtaining a circuit arrangement C which is as simple as possible but which can be matched individually. They differ in how the transfer characteristics of the circuit arrangement C and of the headphones D are combined. This part of the invention will now be explained in greater detail with the aid of FIGS. 13*a* to 19.

Figure 14:
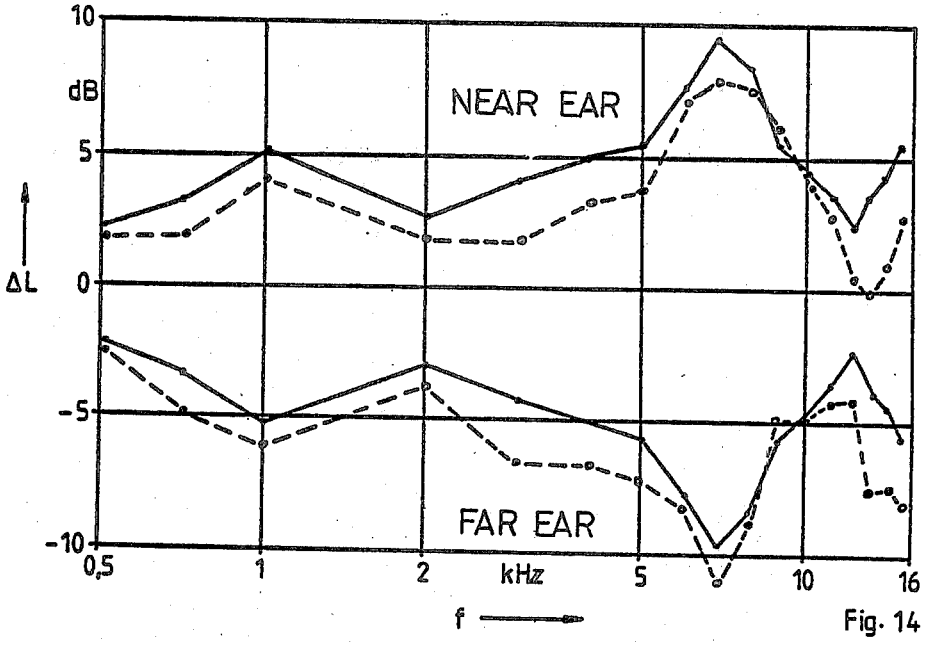
FIG. 14 shows mean monaural transfer constants (near ear and far ear) for a direction of sound incidence of about 30° (dashed curve, according to the Journal of the Acoustical Society of America, Vol. 61 (1977), pages 1567–1576), and in each case half the interaural level difference (continuous curves)
Figure 15:
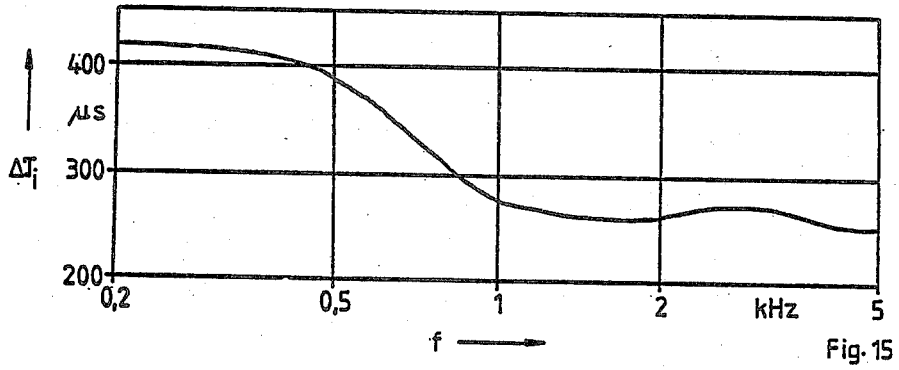
FIG. 15 shows the interaural phase delay difference for a direction of sound incidence of 30° (according to the 9th International Congress on Acoustics, No. 45, Madrid 1977, page 369)

The circuit arrangement C according to the first method has the same circuit structure as is described in German Offenlegungsschrift No. 20 07 623 (see FIG. 13*a*) and consists of four transmission elements C1 and C2, arranged before the summing points, and two delay elements C3. An important simplification in the circuit can be achieved in that the transmission element C1 simulates exactly half the interaural level difference as a rise in level at the near ear and the transmission element C2 simulates the other half of the interaural level difference as a drop level at the far ear. As is shown in FIG. 14, half the interaural level difference agrees with very good approximation with the monaural transfer constants. This is why this circuit arrangement can be operated without any audible tonal erros in conjunction with headphones D with free-field equalization, that is to say the circuit arrangement is compatible with any headphones which have a free-field transfer constant which is independent of frequency in accordance with DIN 45500. Exact localization is guaranteed by the exact simulation of the interaural level difference (FIG. 14) and the interaural delay difference (FIG. 15).

Figure 16:
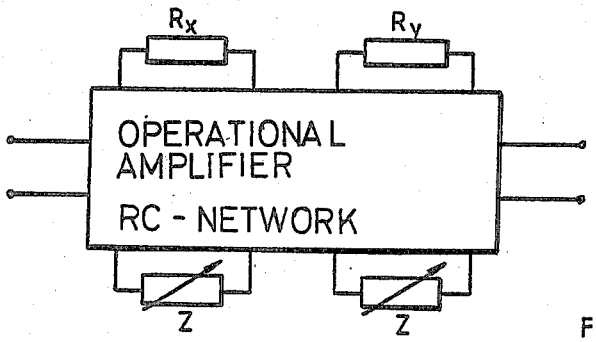
FIG. 16 shows a second-order active resonant circuit.

The circuit arrangement can be simplified due to the fact that, according to the invention, the transfer functions of the transmission elements C1 and C2 are reciprocal with respect to one another. For this reason the transmission elements C1 and C2 can be constructed to be very similar as is shown in FIG. 16. The transmission elements C1 and C2 are implemented by second-order multi-stage (preferably four-stage) resonant circuits. FIG. 16 shows the basic diagram for such a stage in which the resonant circuit is constructed as an active RC circuit. The network contains ohmic resistors $R_x$ and $R_y$ and exchanging them exchanges the functions of band-pass filter and band-rejection filter. In addition, it contains two adjustable capacitive or ohmic impedances Z which determine the resonant frequency of the circuit. By adjusting these impedances the transfer constant of the multi-stage resonant circuit can be matched to half the interaural level difference of the individual listener.

Figure 18:
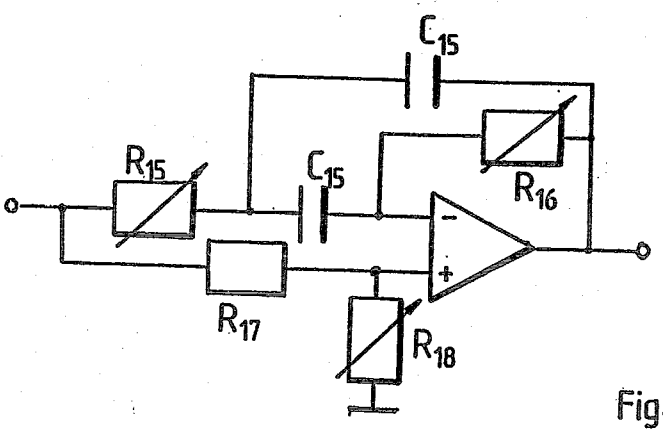
FIG. 18 shows a second-order active band-rejection filter.
Figure 19:
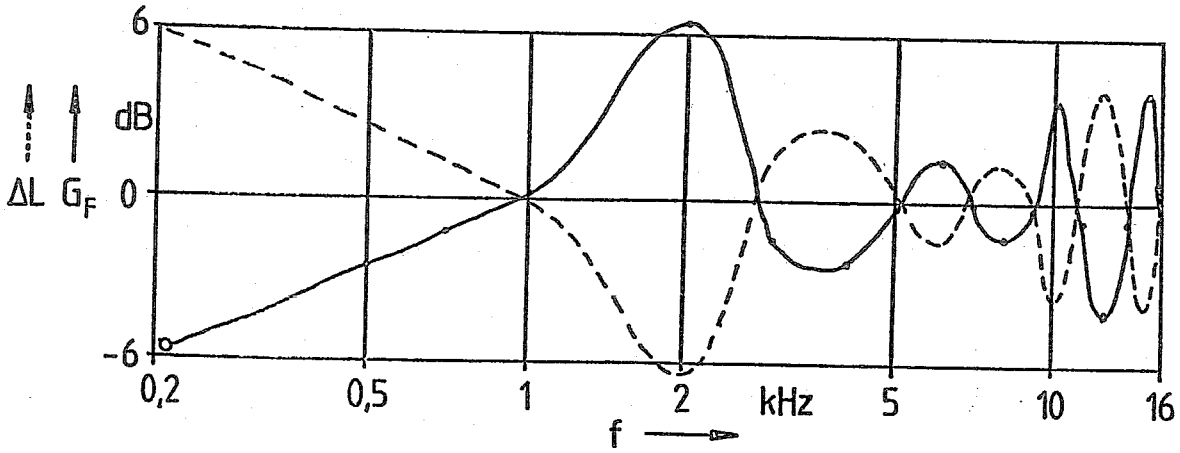
FIG. 19 shows the transfer constant of the circuit arrangement of FIG. 17*b* for two identical input signals (dashed curve) and the free-field transfer constant of the headphone transformer matching the circuit arrangement of FIG. 17*b*.

The delay elements C3, which consist of an iterative circuit of second-order all-pass elements, contribute to the simulation of the interaural delay difference $\Delta\tau i$. As the delay element C3, preferably four of the resonant circuits illustrated in FIG. 18 are provided. Their frequency-dependent delay, in conjunction with the frequency-dependent delay difference between the first and second transmission elements C1 and C2, respectively, simulates the individual, frequency-dependent delay difference of the ear of a certain listener for a direction of sound incidence of 30°. The interaural transfer function can be measured by means of known measuring methods (for example, U.S. Pat. No. 4,143,244) and the filters can be optimized by means of known optimization techniques.

Figure 13A:
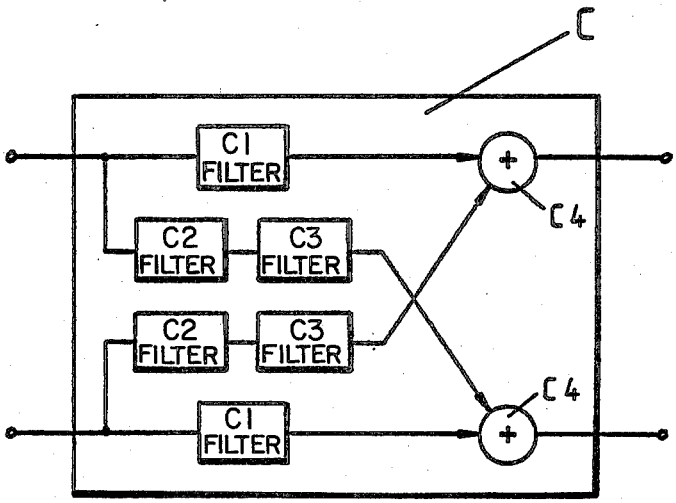
PRIOR ART Fig. 13a
FIGS. 13*a* and 13*b* show two block diagrams of known circuit arrangements.
Figure 13B:
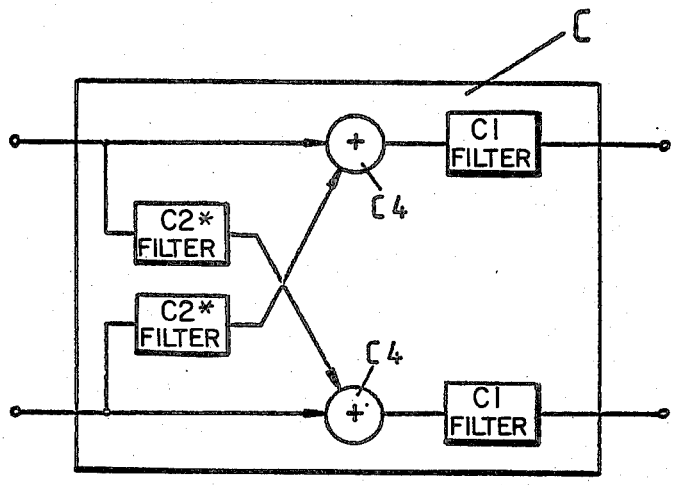
PRIOR ART Fig.13b
Figure 17A:
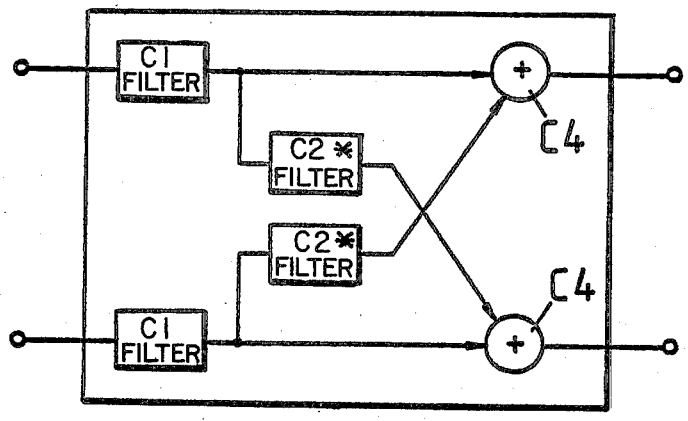
FIGS. 17*a* and 17*b* show block diagrams of the circuit arrangement according to the second method of achieving the object of the invention.
Figure 17B:
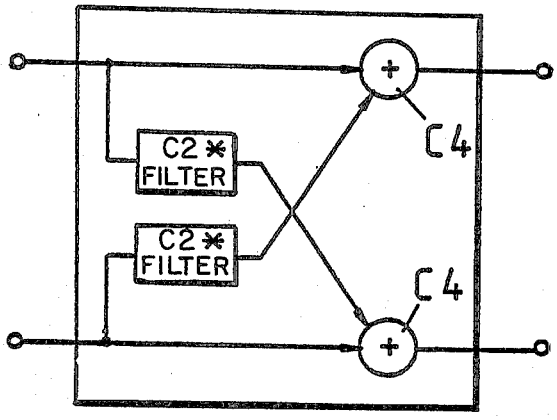

A further simplification of the circuit arrangement C results from the second embodiment, see FIG. 17. In FIG. 17*b* all transmission elements C in the series arms are dispensed with, while transmission elements C1 are arranged in the known circuits of FIG. 13 in front of the summing points C4 (FIG. 13*a*) or behind the summing points (FIG. 13*b*). Similarly, the arrangement shown in FIG. 17*a* is an alternative embodiment to that shown in FIG. 17*b*. The total interaural transfer function is simulated in the respective shunt arm. By iteratively connecting four of the resonant circuits shown in FIG. 18 as band-rejection circuits, both the frequency-dependent interaural level difference (FIG. 14) and the frequency-dependent interaural delay difference (FIG. 15) can be simulated at the same time. Depending on what resistors $R_{15}$ to $R_{18}$ have been selected, a band-rejection filter according to FIG. 18 can have either minimum phase shift or (with the same frequency response) generate additional delays. Each band-rejection filter is determined by three independent parameters (for example the resistors $R_{15}$, $R_{16}$ and $R_{18}$) so that with four resonant circuits twelve independent parameters are available for simulating the individual interaural difference.

This simplified circuit arrangement is so small and weighs so little that is can be built into the head band of the headphones D. In order to prevent localization errors in the median plane, the transformer of the headphones D, which is connected to the circuit arrangement, does not have a frequency-independent free-field transfer constant $G_F$ but has the frequency-dependent free-field transfer constant $G_F$ shown in FIG. 19 by a continuous line. Thus the frequency response of the transformer is inverse to the frequency response of the circuit arrangement for the case of a frontal auditory event. In this case, that is to say with two identical input signals, the output signals of the circuit arrangement C, because of the cross-coupling (with delays), are subject to the frequency response $\Delta$ L (comb filter effect) entered with dashed lines in FIG. 19. By selecting the transformer frequency response to be inverse, the free-field transfer constant of the whole headphone arrangement (circuit arrangement plus transformer) is independent of frequency and corresponds to DIN 45500.

The reproduction arrangements C and D described in the two methods for achieving the object of the invention are suitable for the reproduction of all space-related stereo signals, that is to say both of conventional stereo signals and of those stereo signals of a dummy head A which, for compatibility reasons, have been converted into space-related stereo signals by means of a decoupling filter B.

The invention may be embodied in other specific forms without departing from the spirit or essential characteristics thereof. The embodiments are therefore to be considered in all respects as illustrative and not restrictive.

What is claimed is:

1. A process for stereophonic transmission of sound signals, comprising the steps of:

(a) providing a dummy head containing two microphone arrangements for simulating directional hearing with respect to a human listener;

(b) feeding output signals from said microphone arrangements to two filters each having a frequency response inverse with respect to the free-field transfer constants of said microphone arrangements for providing filter output signals which are independent of frequency; and (c) feeding said filter output signals to a decoupling arrangement having transfer functions determined from said free-field transfer constants of said dummy head containing said microphone arrangements for producing space-related stereophonic signals containing directional information items.

2. The process of claim 1 further comprising the step of recording said space-related stereophonic signals.

3. The process of claim 1 further comprising the step of feeding said space-related stereophonic signals individually to two loudspeakers.

4. The process of claim 1 further comprising the step of feeding said space-related stereophonic signals to an adjustable circuit arrangement producing headphone outputs for matching said space-related sterephonic signals to a listener's individual directional hearing pattern.

5. The process of claim 1 wherein said frequency response of said filter arrangement is inverse with respect to said free-field transfer constant for frontal sound incidence of said microphone arrangements.

6. The process of claim 5, wherein said filter arrangement is a passive band-rejection filter.

7. The process of claim 5, wherein said filter arrangement comprises a band-pass filter;

a first band-rejection filter coupled to said band-pass filter; and a second band-rejection filter coupled to said first band rejection filter.

8. A device (B) for receiving stereophonic signals which are intended for space-related reproduction particularly by means of two separately installed loudspeakers (40, 50), having two microphone channels, comprising a decoupling arrangement (B10) to which the signals of the microphone channels (20, 30) are fed and in which in series arms (B11, B12) of a left transmission channel ($M_{1i}$, $L_1$) and of a right transmission channel ($M_{re}$, $L_2$) in each case a substraction element (B13 and B14, respectively) is arranged which is followed by a transmission element (B15 and B16, respectively), and in which in shunt arms, which provide reverse feedback from the output ($L_1$) of the left transmission channel ($M_{1i}$, $L_1$) to the negative input of the substraction element (B14) arranged in the series arm (B12) of the right transmission channel ($M_{re}$, $L_2$) and from the output ($L_2$) of the right transmission channel ($M_{re}$, $L_2$) to the negative input of the substraction element (B13) arranged in the series arm (B11) of the left transmission channel ($M_{1i}$, $L_1$), in each case a feedback element (B17, B18) is contained, wherein the transmission element (B15) in the series arm (B11) of the left transmission channel ($M_{1i}$, $L_1$) simulates the inverse free-field transfer function of the left microphone channel (20) for the direction of sound incidence ($\phi_1$, $\delta_1$) corresponding to the direction of installation of a first loudspeaker (40), wherein the transmission element (B16) in the series arm (B12) of the right transmission channel ($M_{re}$, $L_2$) simulates the inverse free-field transfer function of the right microphone channel (30) for the direction of sound incidence ($\phi_2$, $\delta_2$) corresponding to the direction of installation of a second loudspeaker (50), wherein the feedback element (B18) providing reverse feedback from the output ($L_2$) of the right transmission channel ($M_{re}$, $L_2$) simulates the free-field transfer function of the left microphone channel (20) for the direction of sound incidence ($\phi_2$, $\delta_2$) corresponding to the direction of installation of the second loudspeaker (50), and wherein the feedback element (B17) providing reverse feedback from the output ($L_1$) of the left transmission channel ($M_{1i}$, $L_1$) simulates the free-field transfer function of the right microphone channel (30) for the direction of sound incidence ($\phi_1$, $\delta_1$) corresponding to the direction of installation of the first loudspeaker (40).

9. A device (B) as claimed in claim 8, wherein in the left and right transmission channels ($M_{1i}$, $L_1$) and ($M_{re}$, $L_2$), respectively, before a decoupling arrangement (B10*), which is reduced by separable parts of its total transfer function, further transmission elements (B61, B71 and B62, B72) are arranged, the transfer functions of which contain the separated parts of the total transfer function of the decoupling arrangement (B10).

10. A device as claimed in claim 9, wherein the transmission elements (B61 and B62) are designed as microphone equalizers (A2) for the microphones (A1) located in the sound pick-up channels (20 and 30).

11. A circuit arrangement (C) for matching a space-related stereophonic program signal to headphones (D) with free-field equalization, in which are in series arms of a left and right transmission channel, a first transmission element (C1) is arranged and in which in shunt arms, which additively couple the left to the right and the right to the left transmission channel, in each case a second transmission element (C2 and C2*) and a delay element (C3) is arranged wherein (a) the first transmission element (C1) is arranged before the summing element (C4) to simulate, by means of an iterative connection of second-order band-pass filters, half the interaural level difference of the ear for a direction of sound incidence of 30°;

(b) the second transmission element (C2) has, by means of iteratively connected second-order band-rejection filters which differ from the band-pass filters of the first transmission element (C1) only by the respective exchange of two resisters (Rx) and (Ry), a transfer function which is the inverse of that of the first transmission element (C1);

(c) the resonant frequencies of all band-pass filters and band-rejection filters are able to be matched by means of variable impedances Z to the resonant frequencies which occur in the frequency response of the individual interaural level difference of the hearing of a certain listener; and (d) variable delay elements (C3) are provided in the shunt arms, said delay elements consisting of iteratively connected second-order all-pass filters the variable frequency dependent delay time of which, in conjunction with the frequency-dependent delay difference, which can be varied by adjusting the resonant frequencies, of the first and second transmission elements (C1) and (C2) simulates the individual, frequency-dependent delay difference of the hearing of a certain listener for a direction of sound incidence of 30°.

* * * * *